US009262870B2

(12) United States Patent
Dalas et al.

(10) Patent No.: US 9,262,870 B2
(45) Date of Patent: Feb. 16, 2016

(54) METHODS AND A SYSTEM FOR DISPENSING

(75) Inventors: Apostolos Dalas, Athens (GR); Ilias Alexopoulos, Athens (GR); Georgios Dimitrakopoulos, Athens (GR)

(73) Assignee: Intralot S.A.—Integrated Lottery Systems and Services, Athens (GR)

( * ) Notice: Subject to any disclaimer, the term of this patent is extended or adjusted under 35 U.S.C. 154(b) by 248 days.

(21) Appl. No.: 12/914,186

(22) Filed: Oct. 28, 2010

(65) Prior Publication Data

US 2012/0109365 A1 May 3, 2012

(51) Int. Cl.
*G07F 17/00* (2006.01)
*G07B 3/02* (2006.01)
*B65H 35/10* (2006.01)

(52) U.S. Cl.
CPC *G07B 3/02* (2013.01); *B65H 35/10* (2013.01); *B65H 2701/1936* (2013.01)

(58) Field of Classification Search
CPC ... B65H 2701/1936; B65H 35/10; G07B 3/02
USPC ..... 700/236, 240, 242–244
See application file for complete search history.

(56) References Cited

U.S. PATENT DOCUMENTS 3,006,567 A * 10/1961 Collins ..... 242/598.6
3,685,690 A * 8/1972 Karecki et al. ..... 221/218
3,894,669 A 7/1975 Wescoat
4,094,451 A 6/1978 Wescoat
4,688,708 A 8/1987 Irvine et al.
4,716,799 A 1/1988 Hartmann
4,945,231 A 7/1990 Ohya et al.
4,954,840 A 9/1990 Maud et al.
4,982,337 A * 1/1991 Burr et al. ..... 700/235
5,100,022 A * 3/1992 Fukudome et al. ..... 221/198
5,104,111 A * 4/1992 Matsuda ..... 271/110
5,836,498 A 11/1998 Turek
5,950,898 A 9/1999 Menna (Continued)

FOREIGN PATENT DOCUMENTS

CN 2432196 Y 5/2001
CN 101577016 A 11/2009

(Continued)

OTHER PUBLICATIONS

European Search Report from European Patent Appln. No. 10191116 dated Apr. 15, 2011.

(Continued)

*Primary Examiner* — Michael K Collins
(74) *Attorney, Agent, or Firm* — Greenberg Traurig, LLP

(57) ABSTRACT

In one example, the invention includes steps of: activating feeding and exiting motors of a dispensing device that cause corresponding rollers to rotate in forward direction, wherein the feeding motor is operatively connected to a displacement optical sensor, wherein the feeding and exiting rollers move a dispensing object; wherein an exit sensor generates a first signal, indicating that a leading edge of the dispensing object has activated the exit sensor, generating, by the stationary displacement optical sensor, a second signal, when, by passing at least one light beam over a surface of the portion of the dispensing object, the stationary displacement optical sensor determines that the portion of the dispensing object has traveled a pre-determined distance along the dispensing passage.

14 Claims, 16 Drawing Sheets

(56) References Cited

U.S. PATENT DOCUMENTS

| | | | | |
|---|---|---|---|---|
| 6,168,151 | B1 * | 1/2001 | Tsuchida | 271/126 |
| 6,669,071 | B1 * | 12/2003 | Menna | 225/106 |
| 6,712,253 | B2 * | 3/2004 | Hargrave et al. | 225/100 |
| 6,726,077 | B2 | 4/2004 | Roberts et al. | |
| 6,886,728 | B2 | 5/2005 | Roberts et al. | |
| 6,932,258 | B1 | 8/2005 | Roberts et al. | |
| 7,032,793 | B2 | 4/2006 | Roberts et al. | |
| 7,234,610 | B2 * | 6/2007 | Skarda et al. | 221/40 |
| 7,364,058 | B2 | 4/2008 | Bartolone et al. | |
| 7,383,099 | B2 | 6/2008 | Pollard et al. | |
| 7,562,798 | B2 | 7/2009 | Bartolone et al. | |
| 7,665,394 | B2 | 2/2010 | Roberts et al. | |
| 7,756,742 | B2 * | 7/2010 | Gilmore et al. | 705/14.38 |
| 7,942,290 | B2 | 5/2011 | Halliburton et al. | |
| 8,127,973 | B2 | 3/2012 | Mirkovic et al. | |
| 8,192,268 | B1 | 6/2012 | Karpe | |
| 8,210,921 | B1 | 7/2012 | Karpe | |
| 8,387,864 | B1 * | 3/2013 | Blackson | 235/379 |
| 2002/0117528 | A1 | 8/2002 | Turek | |
| 2002/0179668 | A1 * | 12/2002 | Hargrave et al. | 225/4 |
| 2003/0120381 | A1 * | 6/2003 | Perin et al. | 700/232 |
| 2004/0000572 | A1 * | 1/2004 | Engelhardt et al. | 225/1 |
| 2004/0200874 | A1 | 10/2004 | Menna | |
| 2005/0061825 | A1 * | 3/2005 | Willoughby et al. | 221/2 |
| 2006/0175344 | A1 * | 8/2006 | Skarda et al. | 221/258 |
| 2006/0293783 | A1 * | 12/2006 | Hand et al. | 700/231 |
| 2007/0017978 | A1 | 1/2007 | Ho | |
| 2007/0283861 | A1 | 12/2007 | Zanotta | |
| 2009/0152292 | A1 | 6/2009 | Mirkovic et al. | |
| 2010/0286817 | A1 * | 11/2010 | Goeking et al. | 700/231 |
| 2012/0109365 | A1 * | 5/2012 | Dalas et al. | 700/231 |
| 2012/0271455 | A1 * | 10/2012 | Dalas et al. | 700/244 |
| 2013/0193155 | A1 * | 8/2013 | Alexopoulos et al. | 221/1 |

FOREIGN PATENT DOCUMENTS

| | | | |
|---|---|---|---|
| CN | 1490236 | A | 10/2010 |
| EP | 2 447 917 | A | 5/2012 |
| JP | H11259695 | A | 9/1999 |
| TW | I249143 | B | 2/2006 |
| TW | 200933532 | A | 8/2009 |

OTHER PUBLICATIONS

Honeywell Sensor Products—Application Note: Applications of Magnetic Position Sensors; Solid State Electronics Center, pp. 1-8.

Bartos, "Measurement Specialities—Absolute Angular Positioning Utilizing Magnetoresistive Sensors", pp. 1-74 © Copyright 2008 Measurement Specialities, Inc.

International Search Report and Written Opinion issued in connection with International Application No. PCT/IB2013/00482 dated Aug. 5, 2013.

Search Report issued in connection with Chinese Patent Application No. 201010552458.X on Apr. 16, 2015.

Search Report from Taiwan Patent Application No. 099137610 dated May 26, 2015.

* cited by examiner

Top View

METHODS AND A SYSTEM FOR DISPENSING

FIELD OF THE INVENTION

One embodiment of the present invention relates to methods and a system for dispensing objects such as tickets (e.g. instant lottery tickets), paper products, and, in general, to any item and/or item in a packaging which one of ordinary skills recognizes to be suitable for a machine-controlled dispensation.

BACKGROUND OF THE INVENTION

One embodiment of the present invention relates to methods and a system for dispensing objects using a machine-controlled dispensation.

SUMMARY OF THE INVENTION

In one example, the instant invention is a method for dispensing that may include steps of: a) activating at least one feeding motor of a dispensing device in a forward movement, i) wherein the at least one feeding motor is operatively connected to at least (a) a stationary displacement optical sensor of the dispensing device and (b) at least one feeding roller of the dispensing device, ii) wherein, upon activation, the at least one feeding motor rotates at least one feeding roller, and iii) wherein, during the forward movement, the at least one feeding roller pushes a portion of a dispensing object along a dispensing passage of the dispensing device; b) activating at least one exit motor of the dispensing device, i) wherein the at least one exit motor is operatively connected to at least (a) the stationary displacement optical sensor of the dispensing device, (b) an exit sensor of the dispensing device, and (c) at least one exit roller of the dispensing device, ii) wherein, upon activation, the at least one exit motor rotates at least one exit roller and wherein the at least one exit roller pulls the portion of the dispensing object along the dispensing passage, and iii) wherein the exit sensor is positioned after the at least one exit roller; c) generating, by the exit sensor, a first signal indicating that a leading edge of the portion of the dispensing object has activated the exit sensor, wherein the exit sensor is operatively connected to the stationary displacement optical sensor; d) generating, upon receiving the first signal, by the stationary displacement optical sensor, a second signal when, by passing at least one light beam over a surface of the portion of the dispensing object, the stationary displacement optical sensor determines that the portion of the dispensing object has traveled a pre-determined distance along the dispensing passage; e) stopping, based on receiving the second signal, the at least one feeding and the at least one exiting motors; f) separating, based on receiving the second signal, the portion of the dispensing object from a remaining portion of the dispensing object; g) re-activating, after separating the portion of the dispensing object, the at least one feeding motor in a reverse movement to pull back, by the at least one feeding roller, the remaining portion of the dispensing object along the dispensing passage to a pre-set position; and h) re-activating, after separating the portion of the dispensing object, the at least one exit motor to dispense the portion of the dispensing object by rotating the at least one exit roller until the exit sensor continues to be activated by the travelling portion of the dispensing object.

In one example, the instant invention is a method for dispensing that may include steps of: a) activating at least one feeding motor of a dispensing device in a forward movement, i) wherein the at least one feeding motor is operatively connected to at least (a) a stationary displacement optical sensor of the dispensing device and (b) at least one feeding roller of the dispensing device, ii) wherein, upon activation, the at least one feeding motor rotates at least one feeding roller of the dispensing device, and iii) wherein, during the forward movement, the at least one feeding roller pushes a portion of a dispensing object along a dispensing passage of the dispensing device; b) activating at least one exit motor of the dispensing device, i) wherein the at least one exit motor is operatively connected to at least (a) the stationary displacement optical sensor, (b) an exit sensor of the dispensing device, and (c) at least one exit roller of the dispensing device, ii) wherein, upon activation, the at least one exit motor rotates at least one exit roller and wherein the at least one exit roller pulls the portion of the dispensing object along the dispensing passage, and iii) wherein the exit sensor is positioned after the at least one exit roller; c) generating, by the exit sensor, a first signal indicating that a leading edge of the portion of the dispensing object has activated the exit sensor, wherein the exit sensor is operatively connected to the stationary displacement optical sensor; d) generating, upon receiving the first signal, by the stationary displacement optical sensor, a second signal, when, by capturing, at a predetermined rate, image frames of a surface of the portion of the dispensing, the stationary displacement optical sensor determines that the portion of the dispensing object has traveled a pre-determined distance along the dispensing passage; e) stopping, based on receiving the second signal, the at least one feeding and the at least one exiting motors when the portion of the dispensing object has traveled the predetermined distance; f) separating, based on receiving the second signal, the portion of the dispensing object from a remaining portion of the dispensing object; g) re-activating, after separating the portion of the dispensing object, the at least one feeding motor in a reverse movement to pull back, by the at least one feeding roller, the remaining portion of the dispensing object along the dispensing passage to a pre-set position; and h) re-activating, after separating the portion of the dispensing object, the at least one exit motor to dispense the portion of the dispensing object by rotating the at least one exit roller until the exit sensor continues to be activated by the travelling portion of the dispensing object.

In one example, the instant invention is a method for dispensing that may include steps of: a) activating at least one feeding motor of a dispensing device in a forward movement, i) wherein the at least one feeding motor is operatively connected to at least (a) a stationary displacement optical sensor of the dispensing device and (b) at least one feeding roller of the dispensing device, ii) wherein, upon activation, the at least one feeding motor rotates at least one feeding roller of the dispensing device, and iii) wherein, during the forward movement, the at least one feeding roller pushes a portion of a dispensing object along a dispensing passage of the dispensing device; b) activating at least one exit motor of the dispensing device, i) wherein the at least one exit motor is operatively connected to at least (a) a stationary displacement optical sensor, (b) an exit sensor of the dispensing device, and (c) at least one exit roller of the dispensing device, ii) wherein, upon activation, the at least one exit motor rotates at least one exit roller and wherein the at least one exit roller pulls the portion of the dispensing object along the dispensing passage, and iii) wherein the exit sensor is positioned after the at least one exit roller; c) generating, by the exit sensor, a first signal indicating that a leading edge of the portion of the dispensing object has activated the exit sensor, wherein the exit sensor is operatively connected to the stationary displacement optical sensor; d) generating, upon receiving the first signal, a second signal based on data received from the stationary displacement optical sensor; wherein, based on a perimeter of the at least one passive wheel, the stationary displacement optical sensor determines that the portion of the dispensing object has traveled a pre-determined distance along the dispensing passage, i) wherein at least one passive wheel continuously contacts a first side of the portion of the dispensing object and is operatively connected to the stationary displacement optical sensor, and ii) wherein the perimeter corresponds to a surface of the at least one passive wheel that has touched the portion of the dispensing object after the stationary displacement optical sensor receives the first signal; e) stopping, based on receiving the second signal, the at least one feeding and the at least one exiting motor when the portion of the dispensing object has traveled the predetermined distance; f) separating, based on receiving the second signal, the portion of the dispensing object from a remaining portion of the dispensing object; and g) re-activating, after separating the portion of the dispensing object, the at least one feeding motor in a reverse movement to pull back, by the at least one feeding roller, the remaining portion of the dispensing object along the dispensing passage to a pre-set position; and h) re-activating, after separating the portion of the dispensing object, the at least one exit motor to dispense the portion of the dispensing object by rotating the at least one exit roller until the exit sensor continues to be activated by the travelling portion of the dispensing object.

In one example, the data received from the stationary displacement optical sensor is based on: i) passing at least one light beam from the stationary displacement optical sensor over at least one side of the portion of the dispensing object, traveling along the dispensing passage, and ii) detecting characteristics of returned light.

In one example, the data received from the stationary displacement optical sensor is based on: i) capturing, at a predetermined rate, by the stationary displacement optical sensor, image frames of at least one side of the portion of the dispensing object, traveling along the dispensing passage, and ii) detecting differences between sequential image frames.

In one example, the at least on feeding motor has a speed of X, wherein the at least on exit motor has a speed of Y, and wherein a difference between X and Y is maintained so as to maintain the traveling portion of the dispensing object at a distance from the stationary displacement optical sensor and in a state of tension, without separating the portion from the remaining portion of the dispensing object prior to the separating step.

In one example, the method further comprise using a tension mechanism to maintain the traveling portion of the dispensing object at a distance from the stationary displacement optical sensor and in a state of tension, without separating the portion from the remaining portion of the dispensing object prior to the separating step.

In one example, the at least one light beam is a non-coherent light beam.

In one example, at least one light beam is a coherent light beam.

In one example, the surface of the portion of the dispensing object corresponds to at least one side of the portion of the dispensing object.

BRIEF DESCRIPTION OF THE DRAWINGS

The present invention will be further explained with reference to the attached drawings, wherein like structures are referred to by like numerals throughout the several views. The drawings shown are not necessarily to scale, with emphasis instead generally being placed upon illustrating the principles of the present invention. Further, some features may be exaggerated to show details of particular components.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed invention. In addition, any measurements, specifications and the like shown in the figures are intended to be illustrative, and not restrictive.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Therefore, specific structural and functional details disclosed herein are not to be interpreted as limiting, but merely as a representative basis for teaching one skilled in the art to variously employ the present invention.

Figure 1:
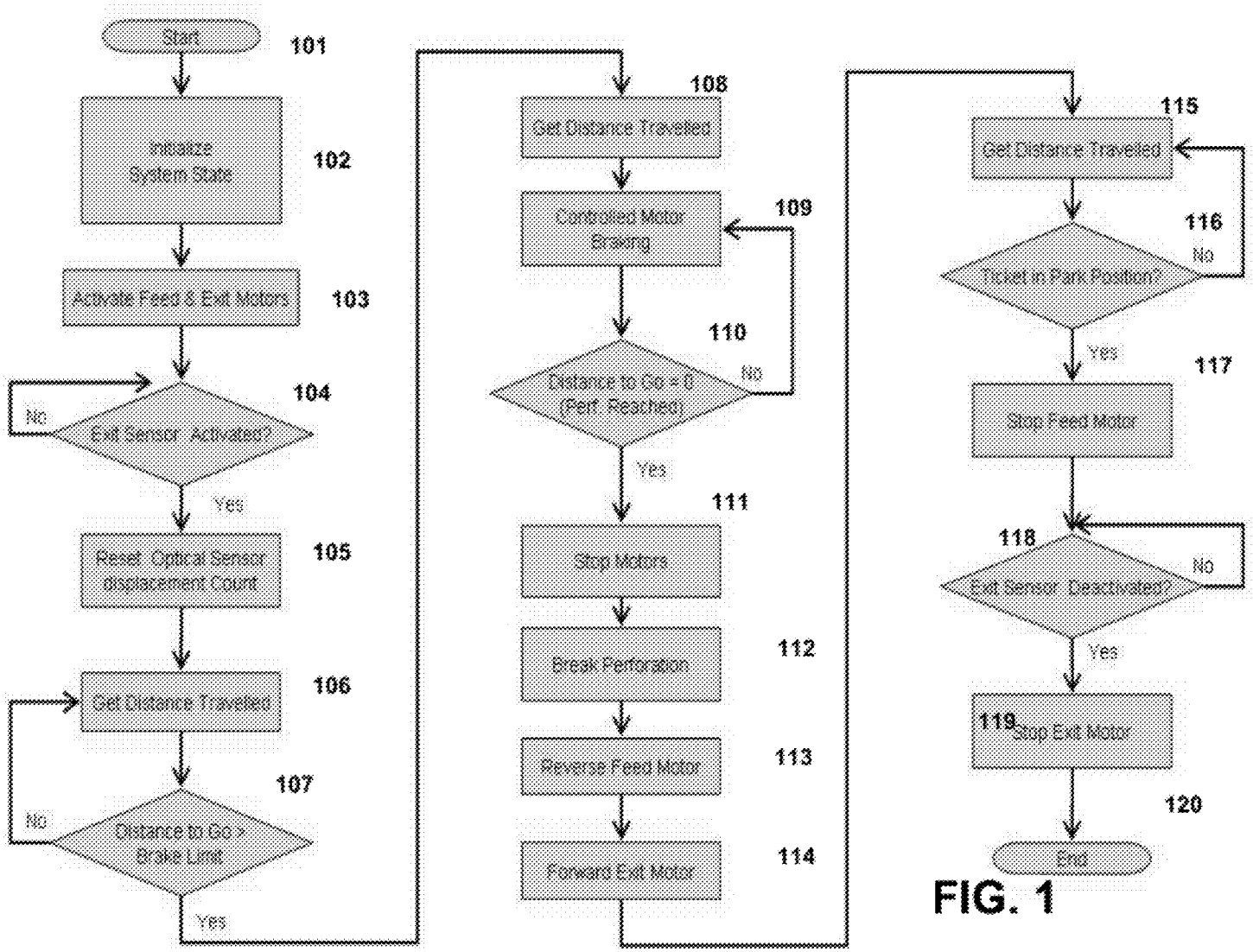
FIG. 1 shows a flow chart of an embodiment of the instant invention.

Referring to FIG. 1 that shows a flow chart of an embodiment of the instant invention. In one example, a device in accordance with at least one principle of the instant invention may begin to dispense a dispensing object (e.g. a roll of tickets, a roll of pouches, etc.) by initializing itself into an initial state (step 102) (e.g., performing self-check of its modules upon application of power and/or pressing a start button (step 101)). In one example, the initialized device then activates (step 103) at least one feeding and at least one exiting motors. In one example, the initialized device activates the at least one feeding and at least one exiting motors in a forward movement. In one example, the at least one feeding motor is operatively connected to at least a stationary displacement optical sensor. In one example, the at least one feeding motor is operatively connected to at least at least one feeding roller.

In one example, upon activation, the at least one feeding motor rotates at least one feeding roller. In one example, during the forward movement, the at least one feeding roller pushes a portion of the dispensing object along a dispensing passage. In one example, the at least one exit motor is also operatively connected to at least the stationary displacement optical sensor. In one example, the at least one exit motor is also operatively connected to at least an exit sensor and at least one exit roller. In one example, upon activation, the at least one exit motor rotates at least one exit roller and wherein the at least one exit roller pulls the portion of the dispensing object along the dispensing passage. In one example, the exit sensor is positioned after the at least one exit roller. In one example, the instant invention checks if the exit sensor generates a signal (step 104), indicating that a leading edge of the portion of the dispensing object has activated the exit sensor. In one example, the signal from the exit sensor indicate that the leading edge of a particular ticket to be dispense from the roll of ticket caused a change in a condition of the exit sensor (e.g. breaching light path, etc.). In one example, the exit sensor is operatively connected to the stationary displacement optical sensor. In one example, if the instant invention receives the signal from the exit sensor that it is being activated, the instant invention resets (step 105) the optical sensor's displacement count since the signal is being indicative of the leading edges of a portion of dispensing object to be dispensed. In one example, the displacement count is associated with a length of the portion of the dispensing object (e.g. a length of a single ticket or a pouch, etc.).

In one example, the instant invention may either continuously or intermittently (after certain period of time: every 0.5 second, 1 second, 2 second, etc) checks (step 106) a distance that the portion of the dispensing object travels. In one example, when the instant invention is applied to dispense tickets (such as instant lottery tickets), in step 106, the instant invention may be programmed to compare the distance traveling by the ticket to its predetermined length. In one example, the instant invention may be programmed to check (step 107) if the ticket's traveled distance is equal to about the ticket's length minus a braking distance (i.e. a distance that the ticket may still travel due to inertia or another condition of motor(s)/roller(s) even when motor(s) receive a stop signal).

In one example, the instant invention utilizing the stationary displacement optical sensor which generates at least one signal that corresponds to a measurement of a distance traveled by the portion of the dispensing object. (e.g. the lottery ticket) when the stationary displacement optical sensor receives the signal from the exit sensor. In one example, the instant system may measure (step 108) the traveled distance based on: a) passing at least one light beam over a surface of the portion of the dispensing object, traveling along the dispensing passage, and b) detecting, based on differences in characteristics of returned light, parameters characterizing a direction and a speed of the portion of the dispensing object to determine a predetermined distance traveled by the portion of the dispensing object.

In one example, the instant invention registers that if the breaking distance has been reached, the instant invention may activate controlled motor braking (step 109). In one example, while the controlled breaking step, the instant invention may continuously, or intermittently, check (step 110) whether the full predetermined traveled distance have been achieved (i.e. the ticket has traveled the predetermined distance equals to about its length or its length). In one example, if the portion of the dispensing object has traveled its full predetermined distance, the instant invention may stop the motors (step 111).

In one example, the instant invention then separates (step 112) the portion of the dispensing object from a remaining portion of the dispensing object (e.g. a cutter cuts off the ticket from the roll of tickets). In one example, the instant invention may then re-activate (step 113) the at least one feeding motor in a reverse movement to pull back, by the at least one feeding roller, the remaining portion of the dispensing object along the dispensing passage to a pre-set position (e.g. the start/park position—step 102). In one example, the instant invention may then also re-activate (step 114) the at least one exit motor to continue move the cut portion of the dispensing object by rotating the at least one exit roller.

In one example, the instant invention may continuously, or intermittently, check (step 115) a distance traveled backwards by the remained portion of dispensing object when the feeding motors are operating in reverse state. when has moved back In one example, the instant invention may continuously, or intermittently, check (step 116) whether the remained portion of dispensing object has moved back to the original position that the previous leading edge of the dispensing object was at the beginning of the dispensing cycle (e.g. a leading edge of a ticket to be dispense next). In one example, if the next ticket is in the park position, the instant invention stops the at least one feeding motor (step 117).

In one example, the instant invention may continuously, or intermittently, check (step 118) whether the exit sensor is still active (e.g. the exiting ticket is still impeding the light path of the exit sensor). In one example, if the exit sensor is deactivated (e.g. its light path is restored), the instant invention stops the at least one exit motor (step 119) and the dispensing the given cycle ends (step 120). In one example, the instant invention proceed to the next cycle of steps 101 through 120, and continues to do so until the dispensing object is completely dispensed (e.g. all tickets from the roll have been dispensed). In one example, as one of ordinary skills would appreciate, the instant invention may be accomplished without performance of all steps, or performance of all steps in the same sequence as detailed, or performance of steps in the exact manner as detailed.

In one example, when dispense starts and the ticket begins to move, any measurements from the displacement optical sensor are discarded. In one example, when the ticket edge triggers the exit sensor, the displacement optical sensor value is registered. In one example, the registration of the displacement optical sensor value sets the initial conditions of the process (i.e. the dispensing cycle). In one example, the displacement optical sensor measures the ticket traveled distance and the ticket motion is controlled for the predetermined ticket length until the perforation line is placed over the separation mechanism. In one example, the ticket motion is stopped and the separation mechanism is activated so that it breaks the perforation.

In one example, the exit transport rollers push the cut ticket out of the mechanism until the exit sensor is clear. In one example, the ticket strip is reversed back to the initial dispense position ready for the next cycle.

In one example, referring to the dispensation of lottery tickets, the at least one feeding roller rotates with a speed that ranges from about 1 to about 300 mm/sec. In one example, the at least one feeding roller rotates with a speed that ranges from about 1 to about 200 mm/sec. In one example, the at least one feeding roller rotates with a speed that ranges from about 1 to about 100 mm/sec. In one example, the at least one feeding roller rotates with a speed that ranges from about 1 to about 50 mm/sec. In one example, the at least one feeding roller rotates with a speed that ranges from about 50 to about 300 mm/sec. In one example, the at least one feeding roller rotates with a speed that ranges from about 100 to about 300 mm/sec.

In one example, referring to the dispensation of lottery tickets, the at least one exiting roller rotates with a speed that ranges from about 1 to about 300 mm/sec. In one example, the at least one exiting roller rotates with a speed that ranges from about 1 to about 200 mm/sec. In one example, the at least one exiting roller rotates with a speed that ranges from about 1 to about 100 mm/sec. In one example, the at least one exiting roller rotates with a speed that ranges from about 1 to about 50 mm/sec. In one example, the at least one exiting roller rotates with a speed that ranges from about 50 to about 300 mm/sec.

In one example, the at least one exiting roller rotates with a speed that ranges from about 100 to about 300 mm/sec.

In one example, a rotation speed of the feeding rollers differs from the rotation speed of the exiting rollers. In one example, the speed differential between speeds of the feeding and exiting rollers varies from about 1:1 to about 1:1.3. In one example, the speed differential between speeds of the feeding and exiting rollers varies from about 1:1 to about 1:1.1. In one example, the speed differential between speeds of the feeding and exiting rollers varies from about 1:1 to about 1:1.5. In one example, the speed differential between speeds of the feeding and exiting rollers varies from about 1:1 to about 1:1.2. In one example, the speed differential between speeds of the feeding and exiting rollers varies from about 1:1 to about 1:2.

In one example, the forward speed of the at least one feeding roller may differ from the reverse speed of the at least one feeding roller. In one example, the speed of the at least one existing roller prior to the separation of the ticket may differ from the speed of the at least one existing roller after the separation.

In one example, the optical sensor may start measuring the distance traveled by the dispensing object or its portion prior to the signal indicating that the leading edge of its portion has reached the exit sensor. In one example, by the measuring distance traveled prior to the signal from the exiting sensor, the present invention may detect mechanical malfunction (e.g. faulty motors, ticket jams in the paper path, etc).

In one example, the characteristics of returned light by which the stationary displacement optical sensor may measure the traveled distance include, but not limited to, texture patterns of the and/or on the dispensing object, scattered light, and/or reflections. In one example, the stationary displacement optical sensor may be Avago, ADNS6530, or any other optical sensor that possesses comparable characteristics. In one example, the stationary displacement optical sensor may need to meet the minimum requirement, identified in Table 1.

TABLE 1

| | Target | | | |
|---|---|---|---|---|
| Parameter | Min | Typical | Max | Units |
| Maximum Speed | 0 | 100 | 300 | mm/sec |
| Acceleration | 0 | | 0.5 | g |
| Dimensions | | X(1D) | | X, Y, Z |
| Accuracy | | | 0.5 | % |

In one example, the instant invention may calculate a distance traveled by capturing image frames. In one example, the stationary displacement optical sensor may extrapolate the traveled distance from the captured images. In one example, the captured images are associated with a count system. In one example, counts may correspond to a distance via a constant ratio defined by a device called CPI:Counts Per Inch. In one example, CPI is operationally connected with the stationary displacement optical sensor. In one example, the distance may be calculated according to the following function:

$$\text{Length(in)}=\text{Sensor counts/CPI.}$$

In one example, a distance between positions of the optical sensor and the exit sensor is predetermined (and/or fixed) through a device design. In one example, the predetermined distance between positions of the optical sensor and the exit sensor allows the instant invention to calculate the predetermined distance that a ticket needs to travel prior to being cut, as follows:

Offset Distance (in inches): Distance from exit sensor to knife (typically known by design).

Ticket Length (in inches): Ticket Length is usually given as a parameter to the inventive dispense mechanism.

In one example, when the leading edge of the dispensing object triggers the exit sensor, the instant invention may calculate the distance remaining prior to the cutting as:

$$\text{DistanceToTravel}=\text{TicketLength}-\text{OffsetDistance}$$

OpticalSensorCounts=0 (Reset) (an example, when the first ticket in the roll to be dispensed by the inventive dispensing device.)

In one example, as the ticket moves forward, the DistanceToTravel parameter is decreased as follows:

$$\text{DistanceToTravel(inch)}=\text{DistanceToTravel(inch)}-\text{OpticalSensorCounts/CPI}$$

Where CPI (sensor Counts Per Inch) is derived from calibration algorithm (FIG. 3) for each sensor & mechanism setup.

In one example, a position of optical sensor may be irrelevant in respect to distance measurement. In one example, the stationary displacement optical sensor is placed at a distance from the knife that is less than the smallest ticket to be dispensed. (e.g. if the smallest ticket is 2 inches, the stationary displacement optical sensor is placed within less than 2 inches from (before) the knife.) In one example, positioning the stationary displacement optical sensor such that its distance from the knife is less than the smallest ticket to be dispensed allows to dispense the two last tickets in a pack.

In one example, the "pre-set" ("park") position may be associated with the cutter (e.g. knife). In one example, the instant invention may position the ticket in a place behind the cutter so that the ticket will not interfere with knife motion (this may be useful in case when there is a multiple channel design of the instant invention).

In one example, referring to the dispensation of lottery tickets, the "pre-set" ("park") position may be 0.5 inch before the cutter. In one example, the "pre-set" ("park") position may be 1.0 inch before the cutter. In one example, the "pre-set" ("park") position may be 0.75 inch before the cutter. In one example, the "pre-set" ("park") position may be 0.25 inch before the cutter. In one example, a distance between the "pre-set" ("park") and the cutter position may range from around 0.25 to about 2 inches before the knife.

In one example of the instant invention, the at least on feeding motor may have a speed of X and the at least on exit motor haves a speed of Y, and a difference between X and Y is maintained so as to maintain the traveling portion of the dispensing object in a state of tension, without separating the portion from the remaining portion of the dispensing object prior to the separating step.

In one example, the instant invention maintains an approximate certain distance (y) between the surface of the traveling dispensing object and the stationary displacement optical sensor. In one example, the distance (y) is determined based on specific characteristics of the light sensor. In one example, for the optical sensor Avago, ADNS6530, the distance (y) displacement can be about 2.4 mm+/−0.2 mm. In one example, the distance (y) may be maintained by using, for instance, a tension mechanism that keeps the ticket's surface always at about the desirable distance from the stationary displacement optical sensor.

Figure 2:
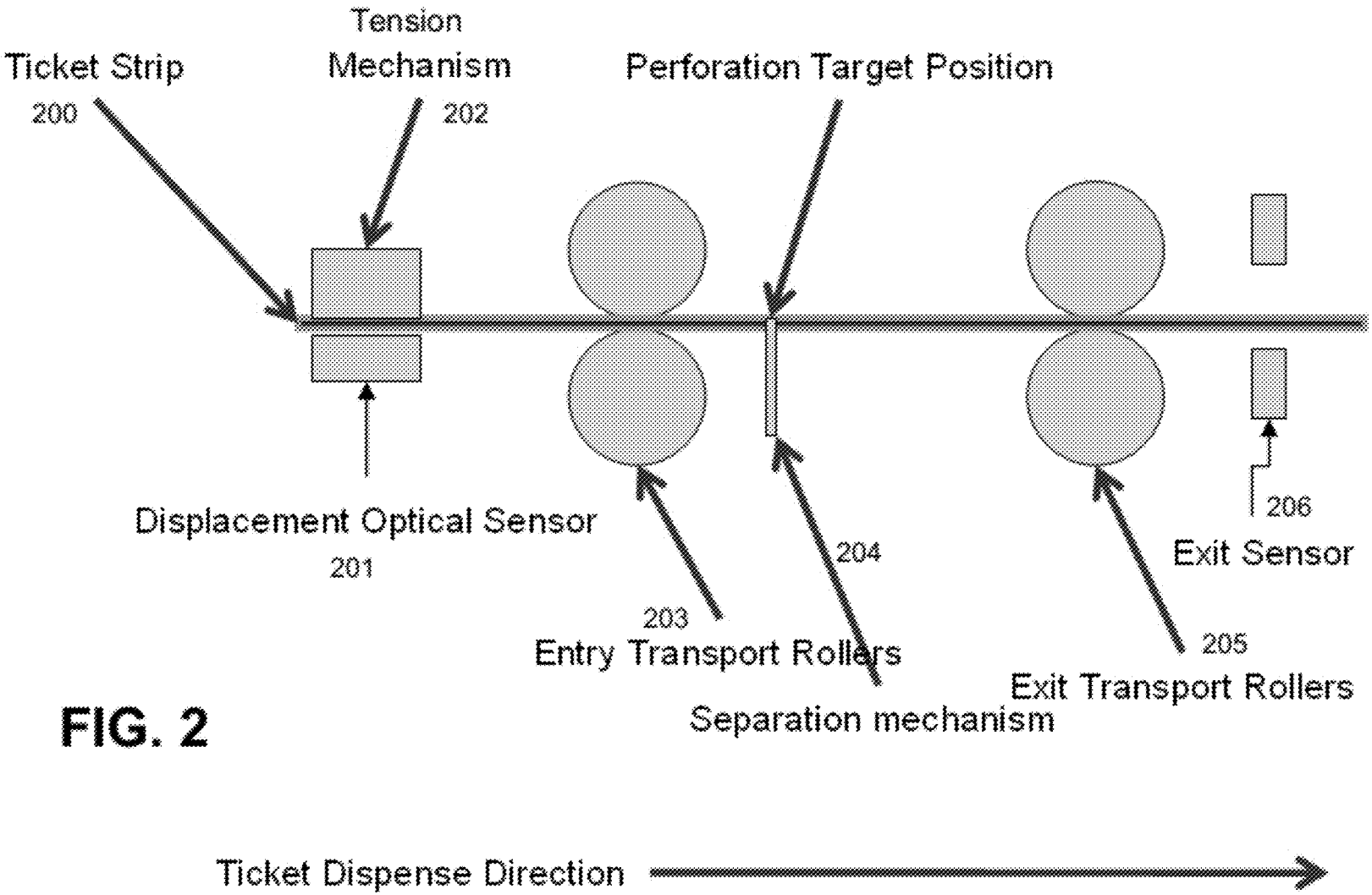
FIG. 2 shows an embodiment of the instant invention.

Referring to FIG. 2 that shows an embodiment of the instant invention. In one example, the instant invention includes the stationary displacement optical sensor 201, as the dispensing object 200 enters the dispensing passage. In one example, the instant invention further includes the tension mechanism 202 (to maintain tension in the strip of tickets for keeping the ticket's surface always at about the desirable distance from the stationary displacement optical sensor 201), located on the opposite side of the dispensing passage and substantially across from the stationary displacement optical sensor 201. In one example, the instant invention further includes two feeding rollers 203, the cutter 204, two exit rollers 205, and the exit sensor 206.

Figure 3:
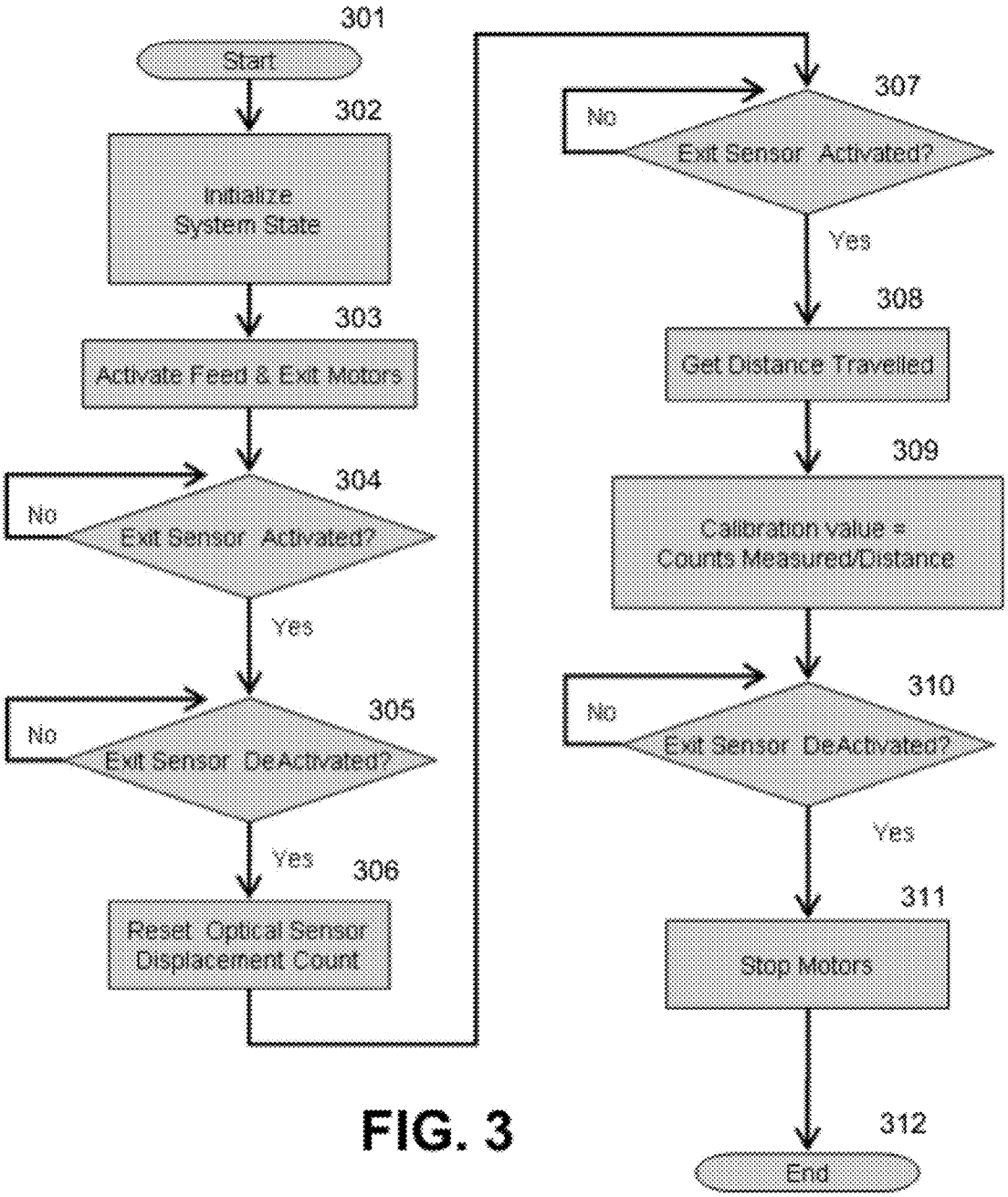
FIG. 3 shows a flow chart of another embodiment of the instant invention.

Referring to FIG. 3 that shows a flow chart of an embodiment of the instant invention which may be utilized to calibrate a system made in accordance with at least some principles of the instant invention. In one example, the calibration may be utilized to enhance the accuracy of the sensor. In one example, referring to the dispensation of lottery tickets, the calibration may use a special test ticket with slot(s) at known position(s) along the ticket's length. In one example, as slot(s) being registered by the exit sensor (by provoking transient change(s) in the exit sensor's condition(s)), the instant invention determines slot(s)' distances in relation to ticket's length is (are) derived. In one example, the instant invention may calculate a correction factor which is used by the instant invention to modify the nominal ratio that translates counts to distance.

In one example of the instant invention, the displacement optical sensor may not need to be aligned with the exit sensor. In one example, the slot(s) do not affect the measuring distance. In one example, the calibration using the test ticket with two slots may proceed as follows. In one example, as the inventive system is initialized (steps 301-302) and upon activation of the feed and exit motors (step 303), the calibration ticket passes above the exit sensor, activating it (step 304). In one example, as the first slot's edge passes over the exit sensor, the exit sensor is deactivated (step 305) and a distance measurement value is reset (step 306). In one example, the distance registering begins using the optical sensor, starting with step 306. As the first slot passes over the exit sensor, the exit sensor becomes activated again (step 307). In one example, when the second slot passes over the exit sensor the measurement value is gathered again (step 308). In one example, the difference of these two values provides a calibration value that correlates counts from the displacement optical sensor with actual distance traveled by the calibration ticket (309).

Figure 4:
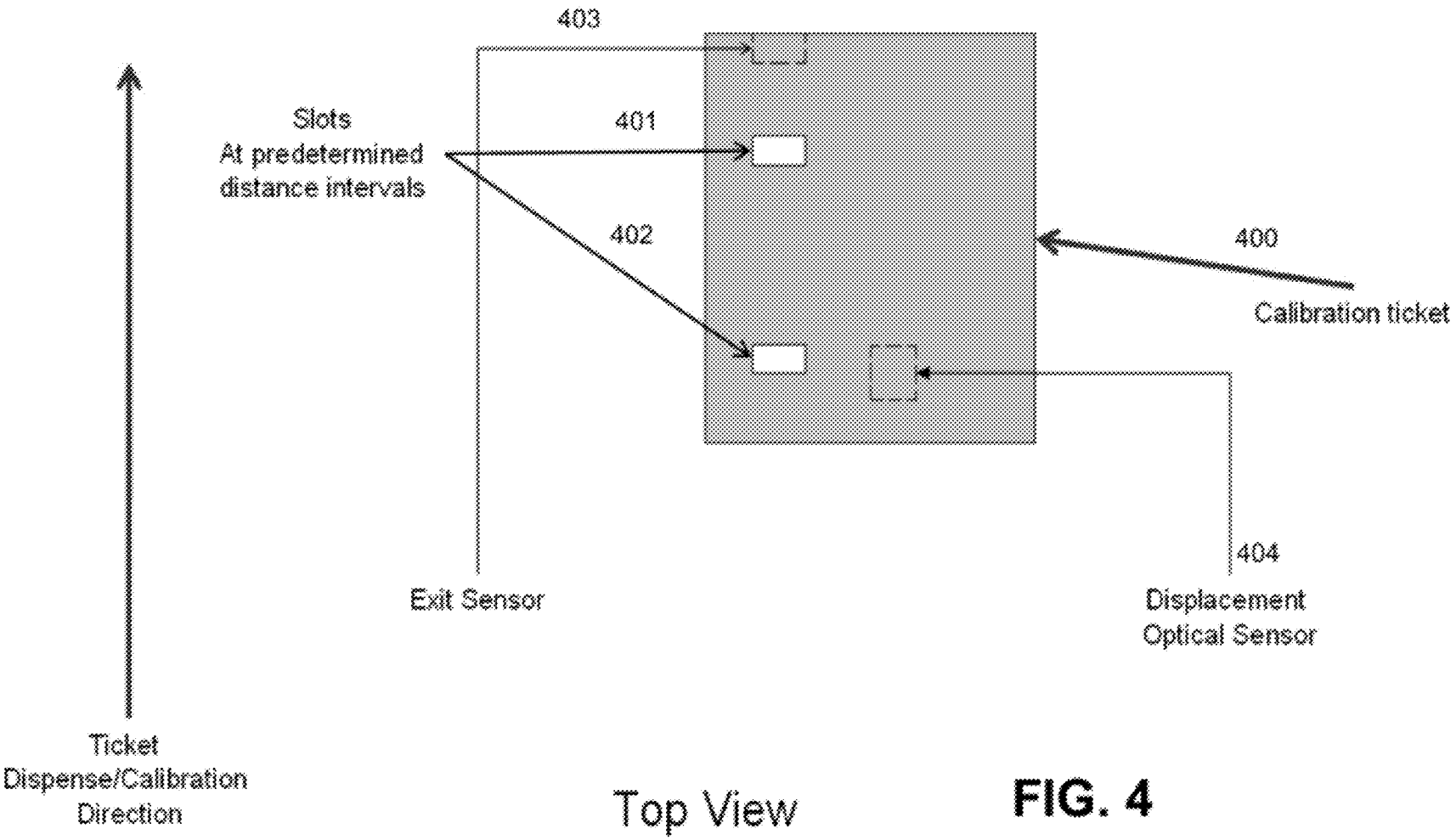
FIG. 4 shows another embodiment of the instant invention.

Referring to FIG. 4 that shows an embodiment of the instant invention to perform the calibration. In one example, the calibration/test ticket (400) may have two slots (401 and 402). In one example, the leading edge of the calibration ticket 400 passes above the exit sensor 403, activating it. In one example, as the first slot's (401) edge passes over the exit sensor (403), the exit sensor is deactivated (403) and a distance measurement value is re-set. In one example, the distance is registered by the optical sensor (404). After the first slot (401) passes over the exit sensor (403), the exit sensor (403) becomes activated again. In one example, when the second slot (402) passes over the exit sensor (403) the measurement value is gathered again by the optical sensor (404).

In one example, the accuracy of the system made in accordance with at least some principles of the instant invention may depend on the sensor accuracy, the mounting, the dispensing object (e.g. tickets), the sensor alignment, or other mechanical factors. In one example, any errors introduced due to mechanical assembly or material variations can be reduced or eliminated with the calibration.

In one example, the instant invention may utilize a coherent light beam illumination and reflection from the displacement optical sensor to measure the ticket traveled distance in order to transport a ticket strip (for dispensing of lottery tickets) and position the ticket's perforation line above the separation mechanism. In one example, the stationary displacement optical sensor may utilize one or more beams of coherent light to measure the ticket displacement by means of the detection of the scattered light which is reflected by the detection surface. In one example, the coherent light emitted by the sensor is focused on the detection surface. In one example, a portion of the emitted light is scattered back into the sensor where it causes variations proportional to the direction and speed of movement producing signals which are then processed in accordance with at least some principles of the instant invention to determine the ticket's direction and displacement. In one example, the displacement optical sensor does not touch the ticket surface but is at an optimal distance which is set based on the characteristics of a particular optical sensor and the inventive system being used, as previously detailed.

In one example, the instant invention may utilize the displacement optical sensor that produces one or more beams of coherent light to measure the ticket direction and displacement by means of the detection and capture of the light reflected by the detection surface. In one example, the coherent light illuminates sufficiently the detection surface. In one example, a portion of the emitted light is reflected back into the image sensor creating image frames. In one example, the image frames of the illuminated area are captured at a certain rate per second. In one example, the instant invention processes changes between one frame and the next by an image processor which translates the received image frames data into two-axial movement using optical flow estimation algorithms. In one example, these optical flow estimation algorithms determine the direction and magnitude of the movement and thus the ticket's (or any other suitable dispensing object) displacement. In one example, a particular optical flow estimation algorithm may be utilized by itself or in a combination with one or more other optical flow estimation algorithms. In one example, the use of particular algorithm(s) is based on at least one of:

a) surface characteristics of the dispensing object;

b) parameters of dispensing (e.g. speed)

c) characteristics of the optical displacement sensor;

d) system design of the instant invention, including but not limiting the design of the dispensing passage;

e) characteristics of the exit sensor, and etc.

In one example, the optical flow estimation algorithms may include, but not limited to, the following algorithms:

Phase correlation—inverse of normalized cross-power spectrum;

Block-based methods—minimizing sum of squared differences or sum of absolute differences, or maximizing normalized cross-correlation;

Differential methods of estimating optical flow, based on partial derivatives of the image signal and/or the sought flow field and higher-order partial derivatives, such as:

Lucas-Kanade Optical Flow Method—regarding image patches and an affine model for the flow field;

Horn-Schunck method—optimizing a functional based on residuals from the brightness constancy constraint, and a particular regularization term expressing the expected smoothness of the flow field;

Buxton-Buxton method—based on a model of the motion of edges in image sequences;

Black-Jepson method—coarse optical flow via correlation (as detailed in S. S. Beauchemin, J. L. Barron (1995). The computation of optical flow. ACM New York, USA, incorporated there in for all purpose, including the description and applications of the Black-Jepson algorithm and its variations, and additional optical flow measuring methods);

General variational methods—a range of modifications/extensions of Horn-Schunck, using other data terms and other smoothness terms; and Discrete optimization methods—the search space is quantized, and then image matching is addressed through label assignment at every pixel, such that the corresponding deformation minimizes the distance between the source and the target image (the optimal solution is often recovered through min-cut max-flow algorithms, linear programming or belief propagation methods).

In one example, the instant invention may directly measure the traveled distance by placing the optical sensor opposite the instant ticket surface and transmitting the beam of light directly onto the ticket's surface. In one example, the instant invention may indirectly measure the traveled distance by utilizing a passive freely rotating wheel that is in contact with the ticket surface (e.g. the wheel's rotation follows the ticket's displacement). In one example, the displacement optical sensor may be placed opposite the wheel's surface or the wheel core surface and transmit the beam of light onto the measured surface of the wheel. In one example, the ticket's displacement measured by the displacement optical sensor may correspond to a perimeter of the surface of the passive wheel that has touched the portion of the dispensing object during the measuring period. In one example, the dispensing object's (e.g. ticket's strip) displacement may be then calculated by adjusting the measured value accordingly. In one example, measuring the perimeter of the surface of the passive wheel allows the measurement to be independent from the wheel's characteristic(s). In one example, measuring the perimeter of the surface of the passive wheel allows to reduce or eliminate slippage of the ticket surface from and/or in the dispensing passage.

In one example, the displacement optical sensor may measure parameter(s)/characteristic(s) associated with the passive wheel's core (which does not touch surface of the dispensing object) by calibrating the displacement optical sensor's measurement to the measured parameter(s)/characteristic(s) of the passive wheel's core.

In one example, the top side of the dispensing object may be utilized for the measurement of the object's traveled distance. In one example, the bottom side of the dispensing object may be utilized for the measurement of the object's traveled distance. In one example, either lateral (side) surface of the dispensing object may be utilized for the measurement of the object's traveled distance.

In one example, the instant invention may maintain the substantially constant optimal distance between the dispensing object's surface and the displacement optical sensor by keeping the object (e.g. strip of tickets) always at a tension so that the object's surface, which is opposite to the optical sensor, is substantially straightened. In one example, the instant invention may maintain the tension by having, for instance, two pairs of drive shafts (which may be utilized in addition or instead of the at least one feeding and/or at least one exiting rollers) that are driven by motors and have a small speed differential which is kept constant so that to maintain the desirable tension on the dispensing object but the tension does not exceed a certain amount which could lead to an accidental tearing of the perforation. In one example, the displacement optical sensor may be positioned between the two drive shafts.

Figure 5A:
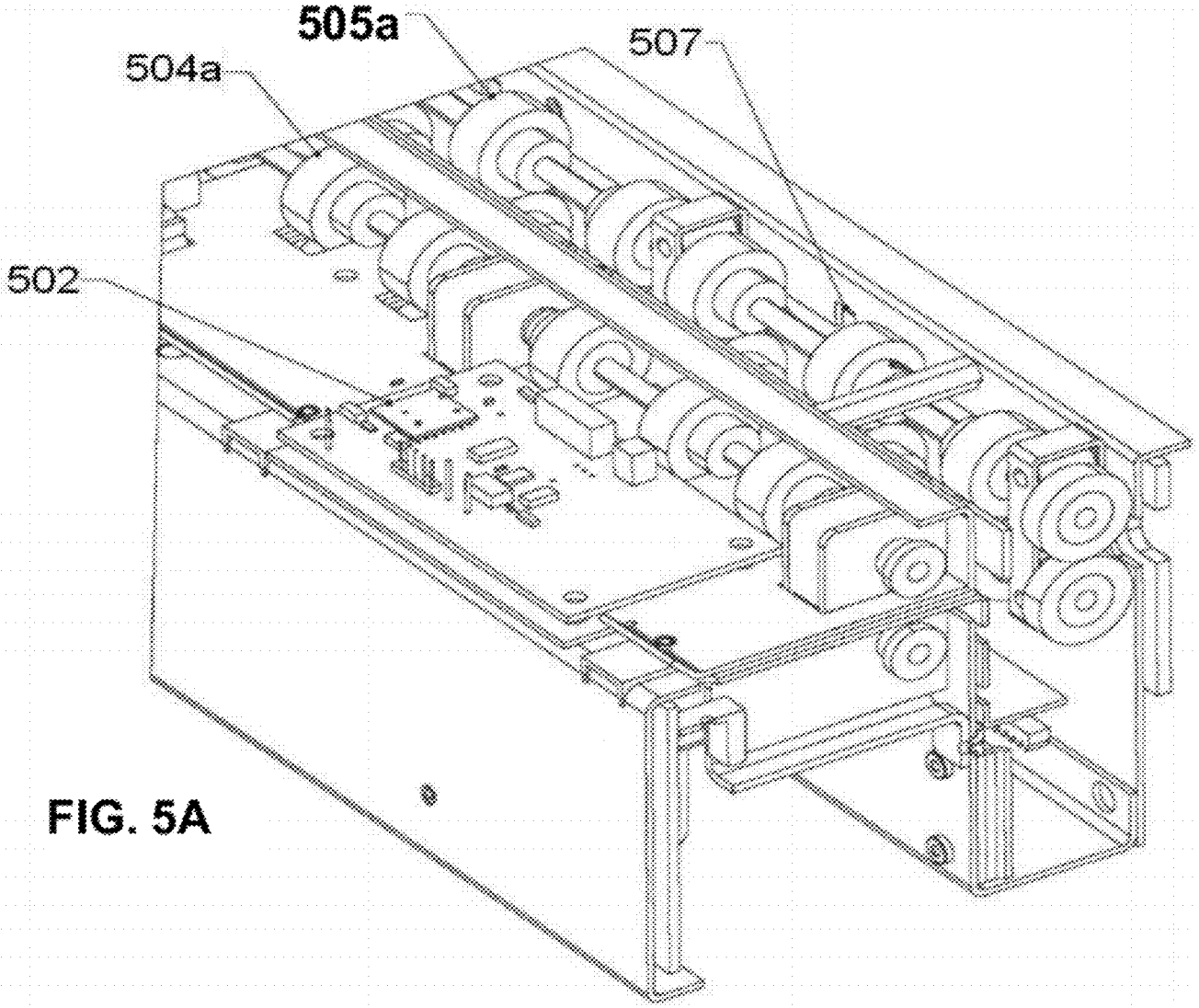
FIGS. 5A, 5B, and 5C show an embodiment of the instant invention.
Figure 5B:
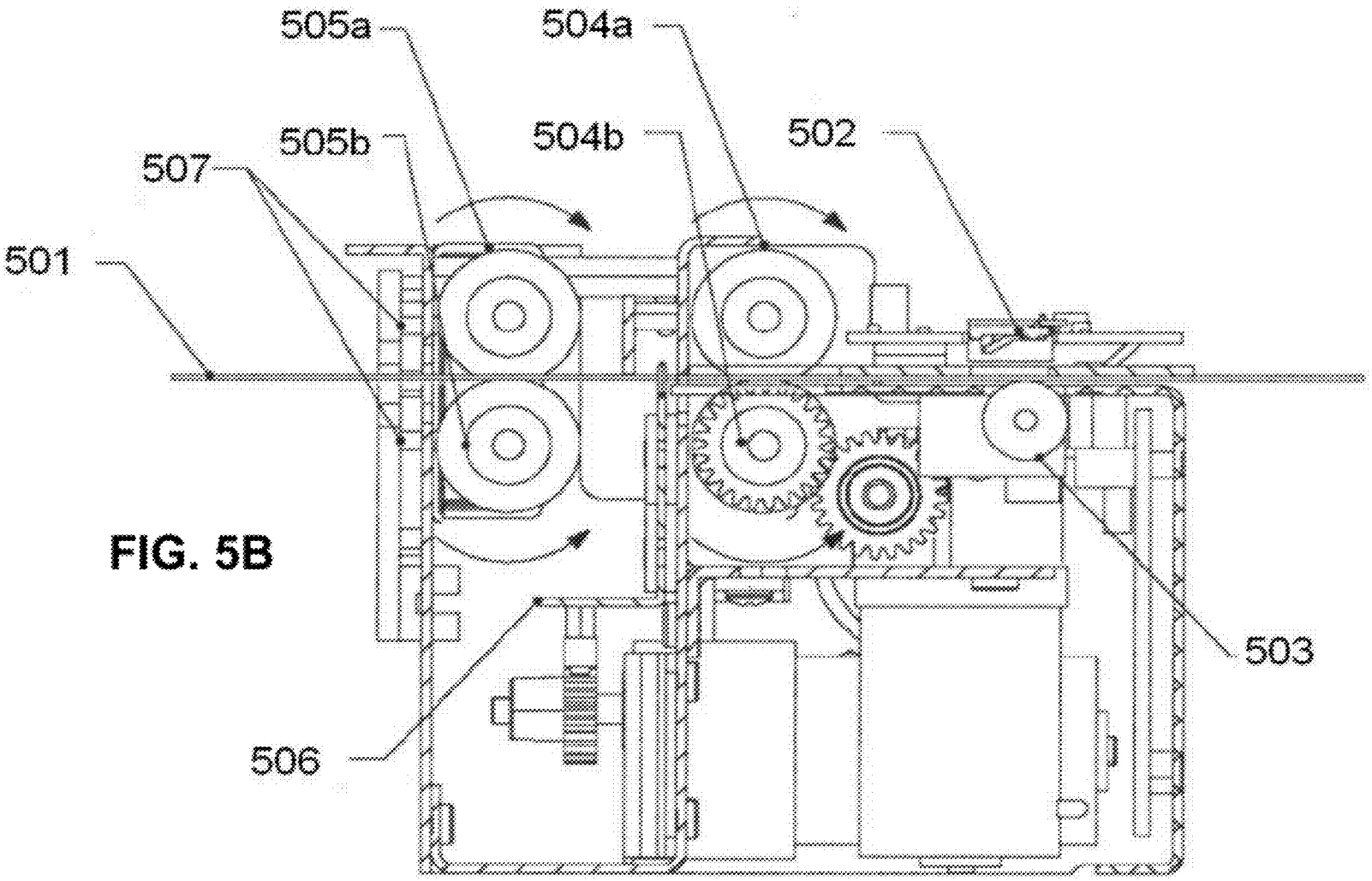
Figure 5C:
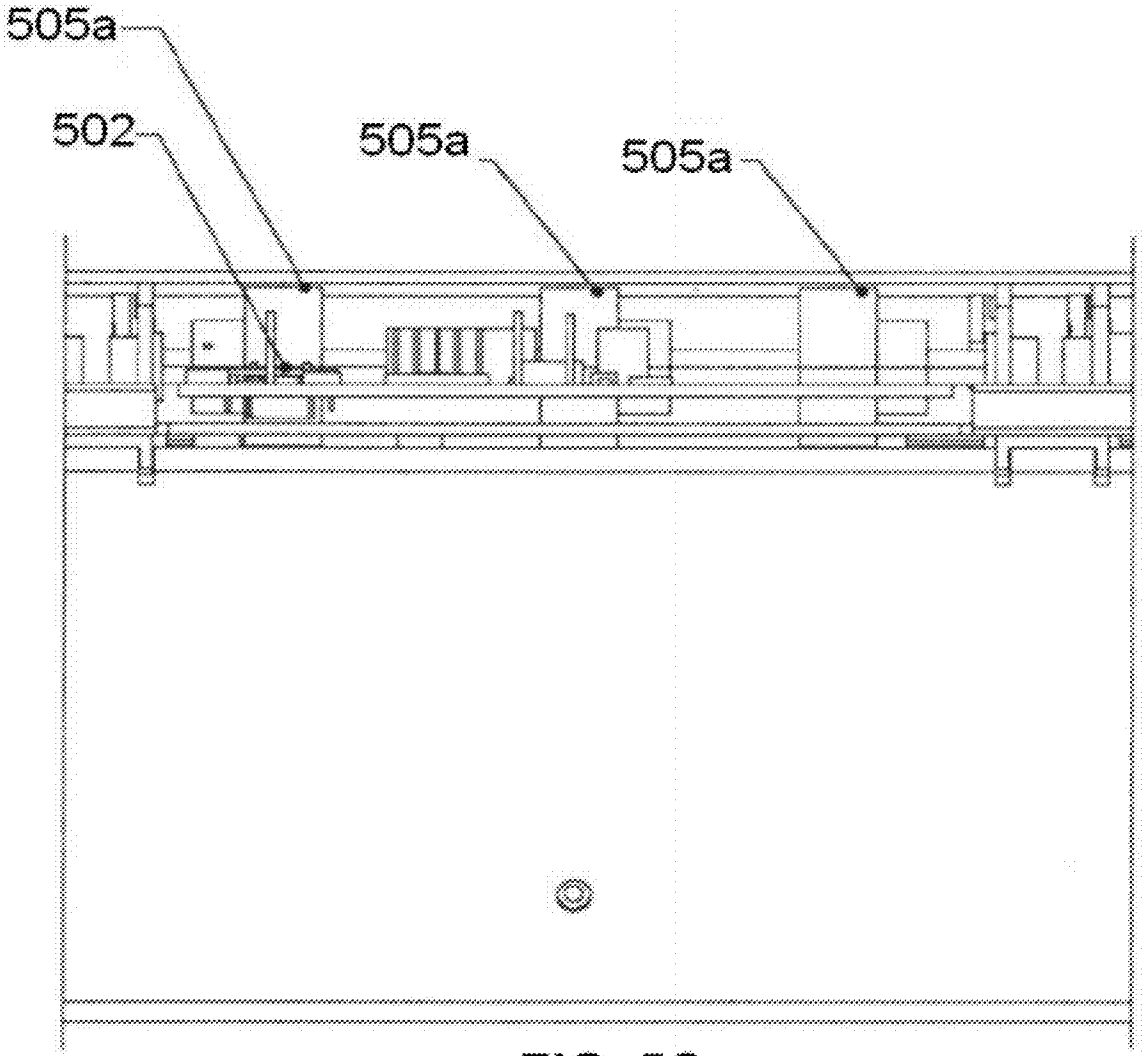

Referring to FIGS. 5A, 5B, and 5C that show an embodiment of the instant invention. In one example, the embodiment of the instant invention may be arranged as having a dispensing object (e.g. ticket strip) 501 that is being fed by at least one active feeding (entry) roller 504*b*, and further moved by at least one active exiting roller 505*b*. In one example, the embodiment of the instant invention may be arranged to have at least one passive feeding (entry) roller 504*a* (only moves due to a movement of the dispensing object 501) to be position against an opposite side of the dispensing object 501 from the at least one active feeding (entry) roller 504*b*. In one example, the embodiment of the instant invention may be arranged to have at least one passive exiting roller 505*a* (only moves due to a movement of the dispensing object 501) to be position against an opposite side of the dispensing object 501 from the at least one active exiting roller 505*b*.

In one example, the embodiment of the instant invention may be arranged to have the displacement optical sensor 502 to be positioned over the dispensing object (i.e. the top-direct measurement). In one example, the embodiment of the instant invention may be further arranged to have the tension mechanism 503 and the separation mechanism 506 (e.g. cutter/knife, other suitable mechanism). In one example, the embodiment of the instant invention may be further arranged to have at least one exit sensor 507 which is activated/triggered when a leading edge of the dispensing object enters/crosses an area/path monitored by the exit sensor 507.

Figure 6A:
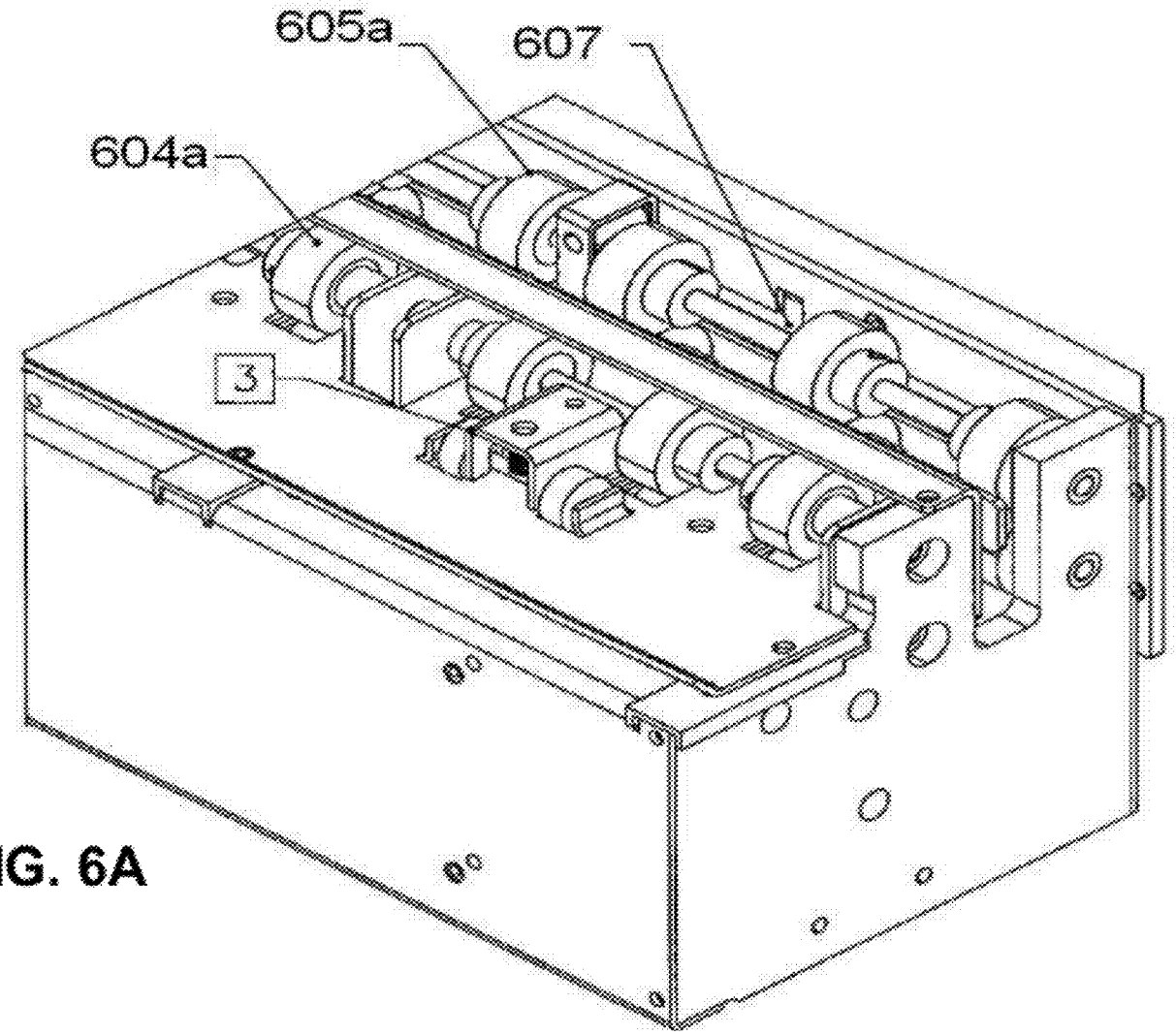
FIGS. 6A, 6B, and 6C show an embodiment of the instant invention.
Figure 6B:
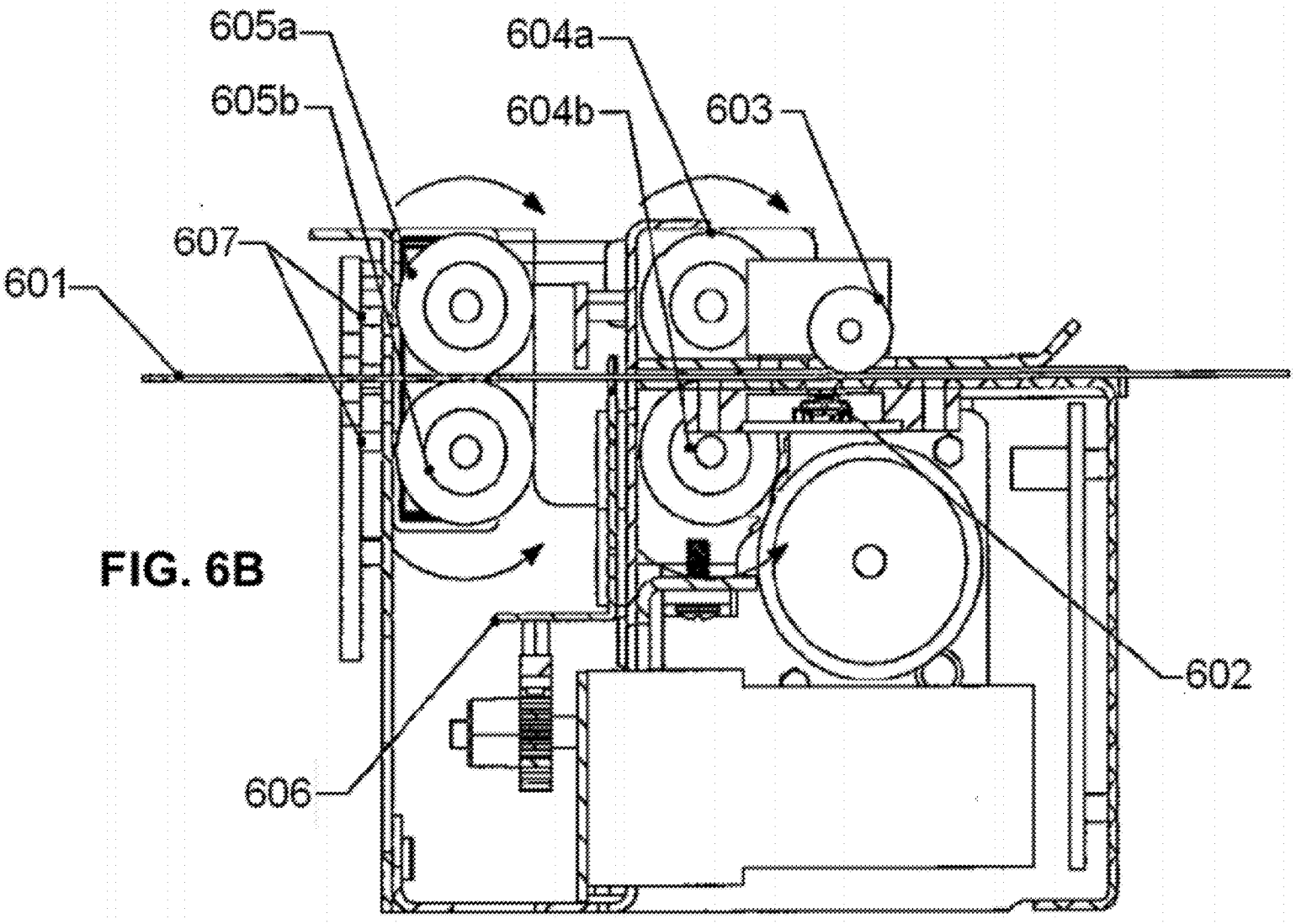
Figure 6C:
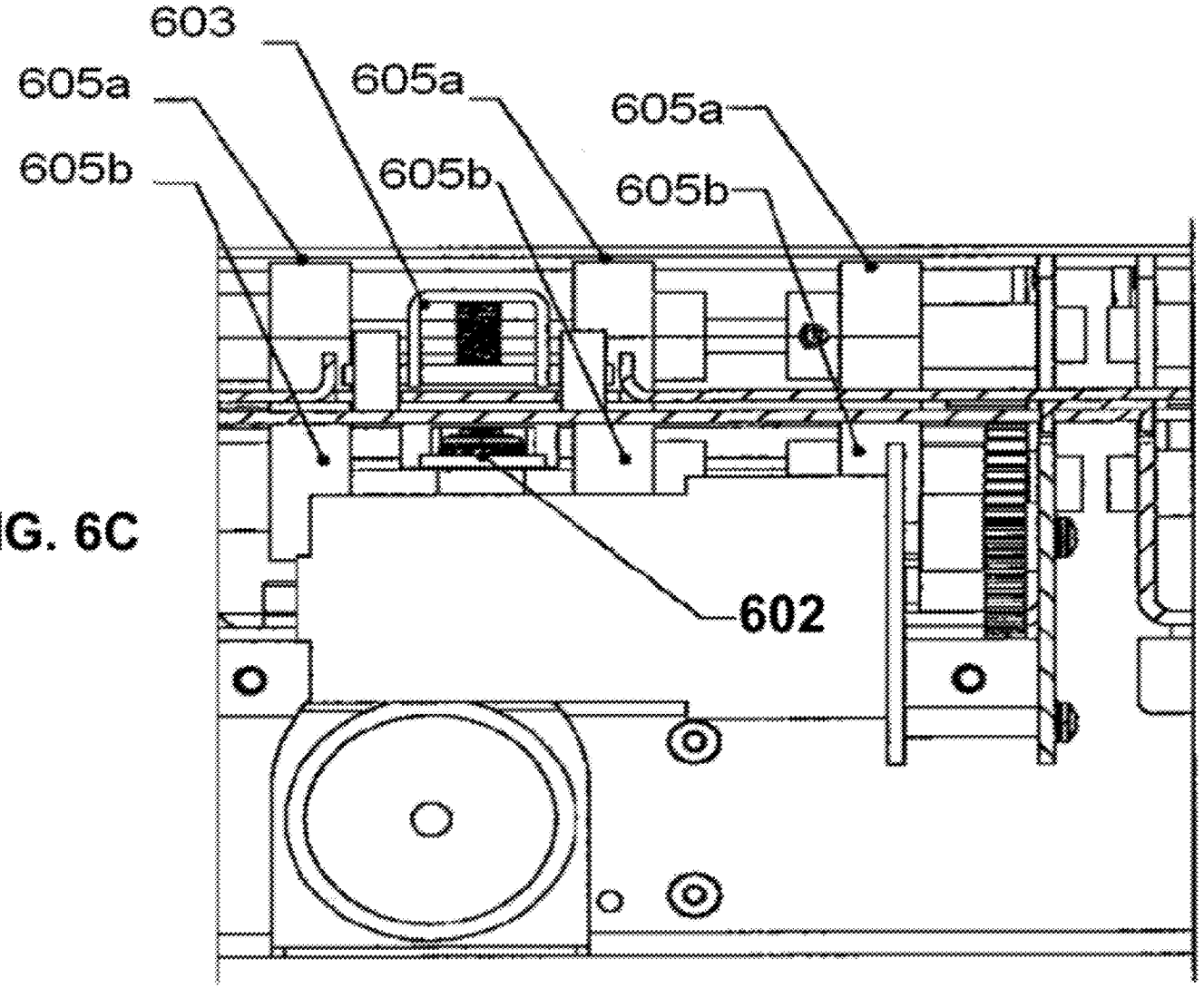

Referring to FIGS. 6A, 6B, and 6C that show an embodiment of the instant invention. In one example, the embodiment of the instant invention may be arranged as having a dispensing object (e.g. ticket strip) 601 that is being fed by at least one active feeding (entry) roller 604*b*, and further moved by at least one active exiting roller 605*b*. In one example, the embodiment of the instant invention may be arranged to have at least one passive feeding (entry) roller 604*a* (only moves due to a movement of the dispensing object 601) to be position against an opposite side of the dispensing object 601 from the at least one active feeding (entry) roller 604*b*. In one example, the embodiment of the instant invention may be arranged to have at least one passive exiting roller 605*a* (only moves due to a movement of the dispensing object 601) to be position against an opposite side of the dispensing object 601 from the at least one active exiting roller 605*b*.

In one example, the embodiment of the instant invention may be arranged to have the displacement optical sensor 602 to be positioned under the dispensing object (i.e. the bottom-direct measurement). In one example, the embodiment of the instant invention may be further arranged to have the tension mechanism 603 and the separation mechanism 606 (e.g. cutter/knife, other suitable mechanism). In one example, the embodiment of the instant invention may be further arranged to have at least one exit sensor 607 which is activated/triggered when a leading edge of the dispensing object enters/crosses an area/path monitored by the exit sensor 607.

Figure 7A:
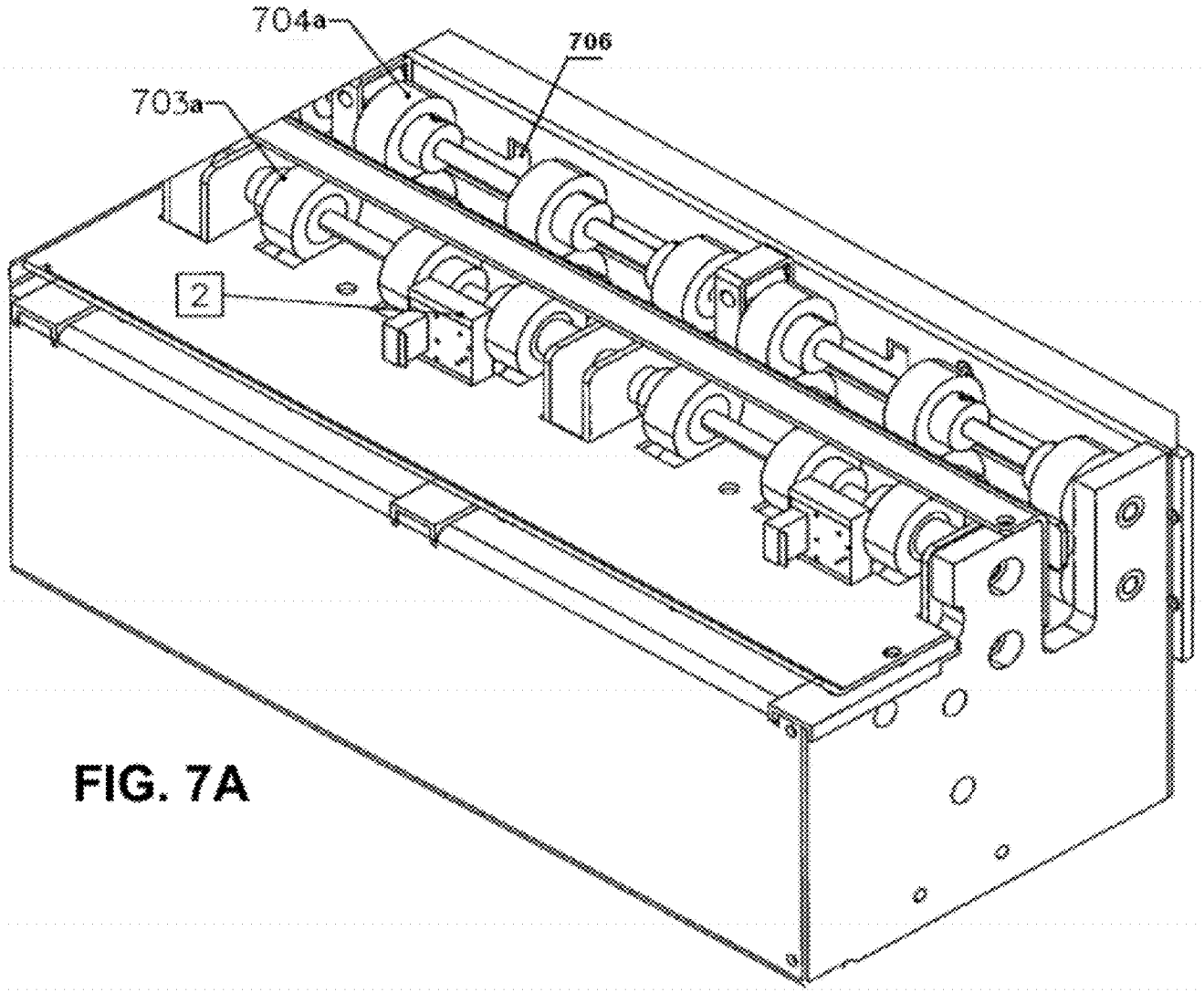
FIGS. 7A, 7B, and 7C show an embodiment of the instant invention.
Figure 7B:
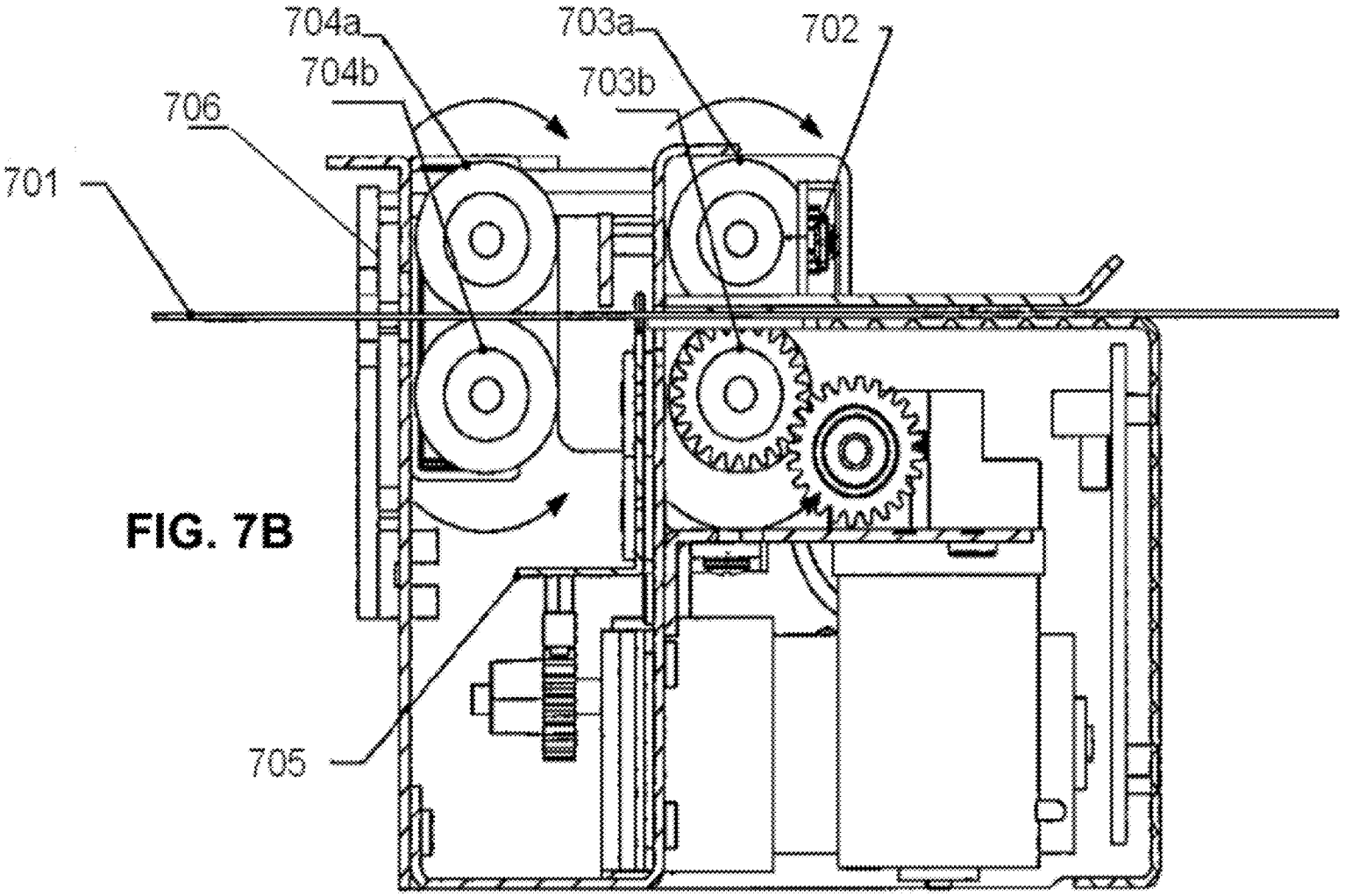
Figure 7C:
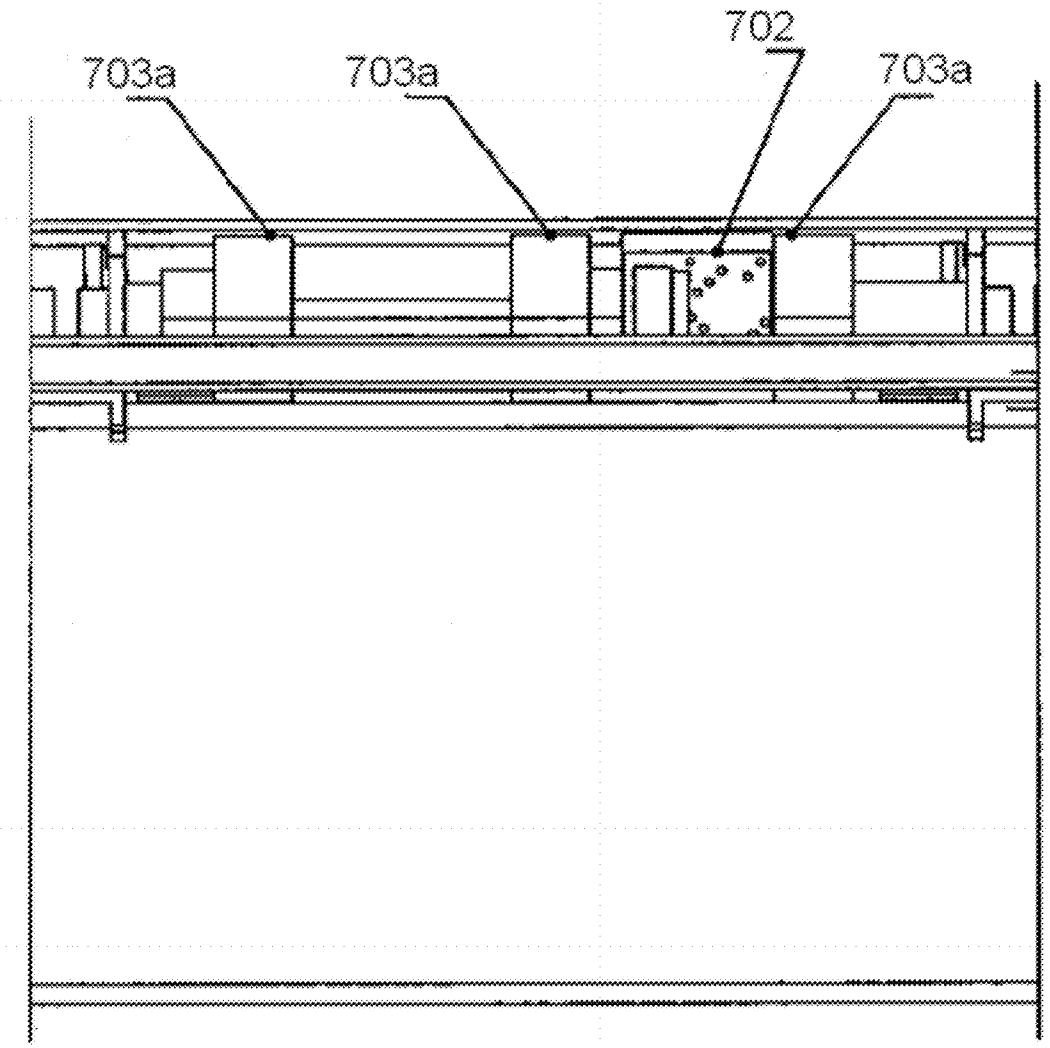

Referring to FIGS. 7A, 7B, and 7C that show an embodiment of the instant invention. In one example, the embodiment of the instant invention may be arranged as having a dispensing object (e.g. ticket strip) 701 that is being fed by at least one active feeding (entry) roller 703*b*, and further moved by at least one active exiting roller 704*b*. In one example, the embodiment of the instant invention may be arranged to have at least one passive (only moves due to a movement of the dispensing object 701) feeding (entry) roller 703*a* to be position against an opposite side of the dispensing object 701 from the at least one active feeding (entry) roller 703*b*. In one example, the embodiment of the instant invention may be arranged to have at least one passive exiting roller 704*a* (only moves due to a movement of the dispensing object 701) to be position against an opposite side of the dispensing object 701 from the at least one active exiting roller 704*b*. In one example, the embodiment of the instant invention may be arranged to have an exit sensor 706. In one example, the embodiment of the instant invention may be arranged to have the displacement optical sensor 702 to be positioned next to the at least one passively rotating roller/wheel 703*a* (e.g. the top wheel: the top-indirect measurement) to measure parameter(s)/characteristic(s) of the at least one passively rotating roller/wheel 703*a* that are associated with the movement of the dispensing object 701. In one example, the embodiment of the instant invention may be further arranged to have the separation mechanism 705 (e.g. cutter/knife, other suitable mechanism).

Figure 8A:
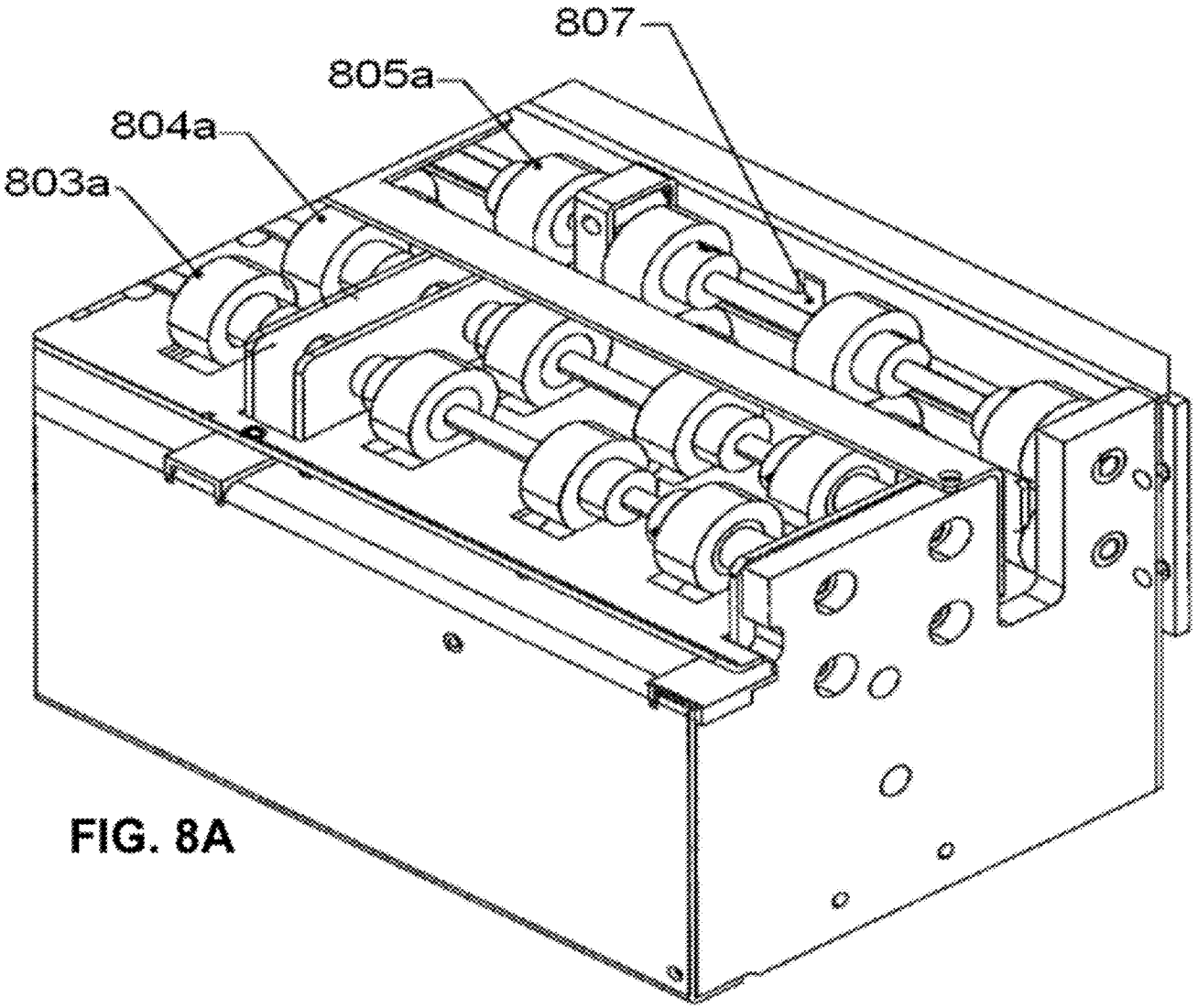
FIGS. 8A, 8B, and 8C show an embodiment of the instant invention.
Figure 8B:
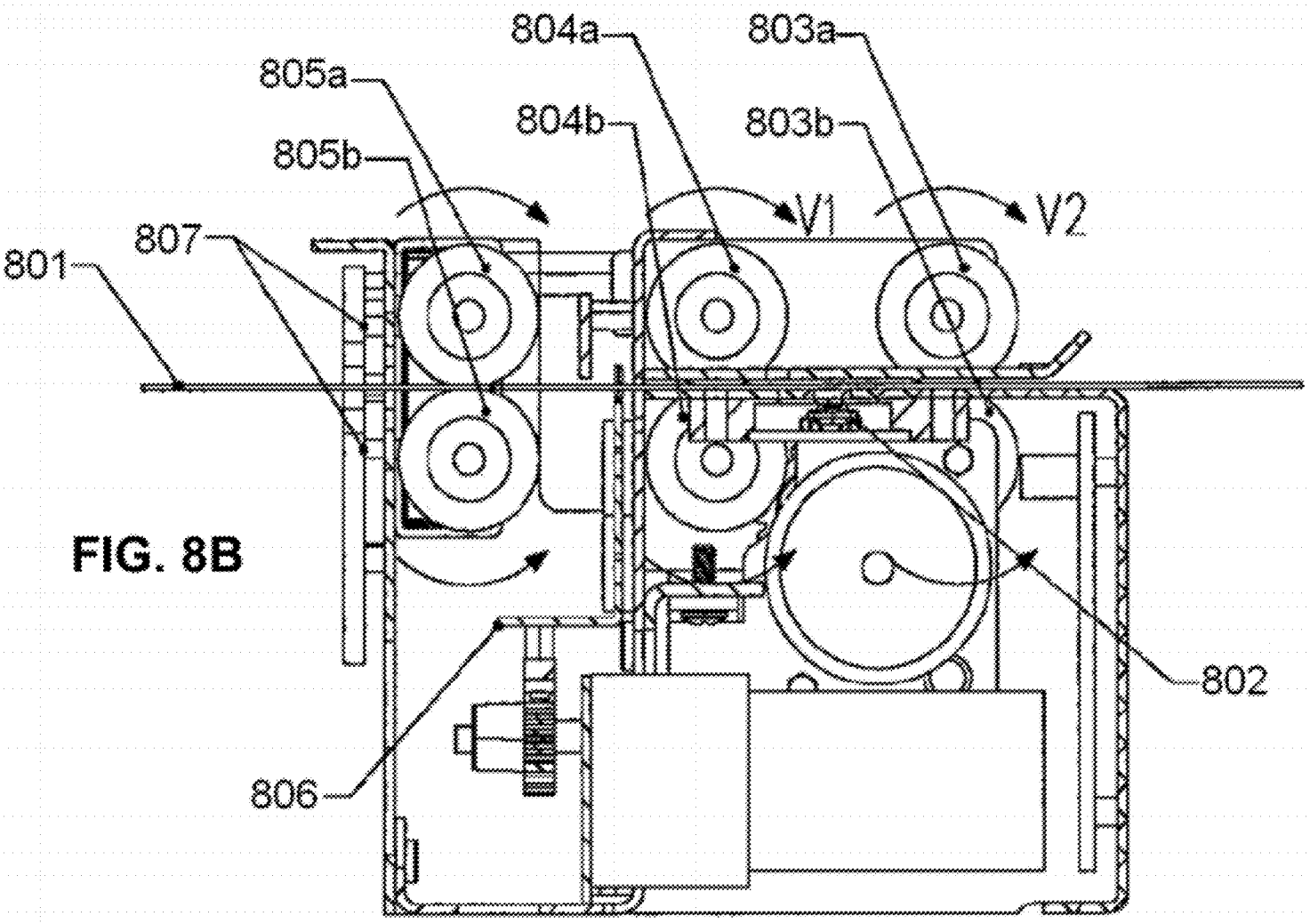
Figure 8C:
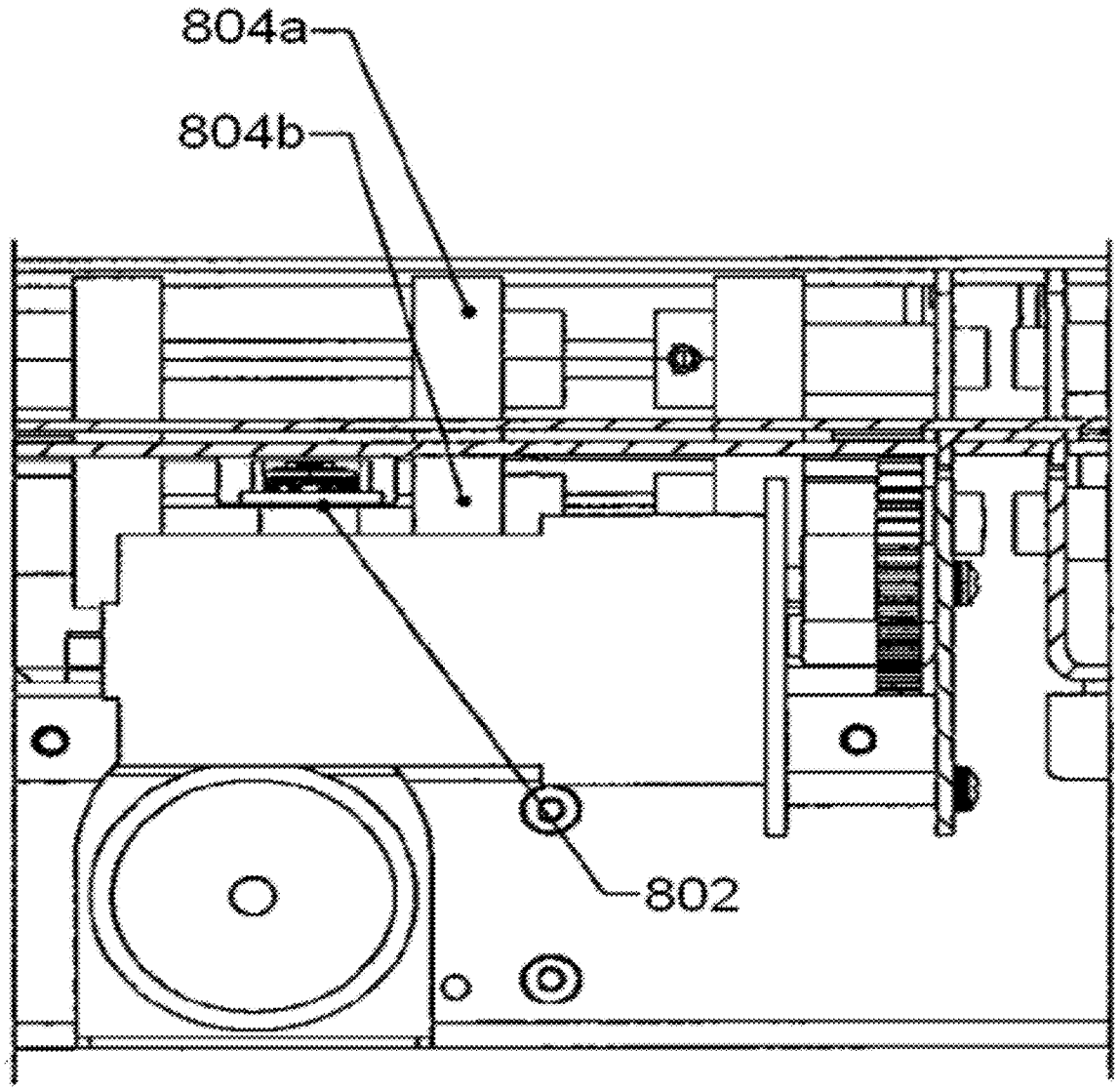

Referring to FIGS. 8A, 8B, and 8C that show an embodiment of the instant invention. In one example, the embodiment of the instant invention may be arranged as having a dispensing object (e.g. ticket strip) 801 that is being moved by a plurality of active feeding (entry) rollers 803*b* and 804*b*, and further moved by at least one active exiting roller 805*b*. In one example, the embodiment of the instant invention may be arranged to have a plurality of passive feeding (entry) rollers/wheels 803*a* and 804*a* (only moves due to a movement of the dispensing object 801) to be position against an opposite side of the dispensing object 801 from the plurality of the active feeding (entry) rollers 803*b* and 804*b*. In one example, the embodiment of the instant invention may be arranged to have at least one passive exiting roller 805*a* (only moves due to a movement of the dispensing object 801) to be position against an opposite side of the dispensing object 801 from the at least one active exiting roller 805*b*.

In one example, the embodiment of the instant invention may be arranged to have the displacement optical sensor 802 to be positioned under the dispensing object (i.e. the bottom-direct measurement). In one example, the embodiment of the instant invention may be further arranged to have the separation mechanism 806 (e.g. cutter/knife, other suitable mechanism). In one example, the embodiment of the instant invention may be further arranged to have at least one exit sensor 807 which is activated/triggered when a leading edge of the dispensing object enters/crosses an area/path monitored by the exit sensor 807.

In one example, the instant invention is a method for dispensing that may include steps of: a) activating at least one feeding motor of a dispensing device in a forward movement, i) wherein the at least one feeding motor is operatively connected to at least (a) a stationary displacement optical sensor of the dispensing device and (b) at least one feeding roller of the dispensing device, ii) wherein, upon activation, the at least one feeding motor rotates at least one feeding roller, and iii) wherein, during the forward movement, the at least one feeding roller pushes a portion of a dispensing object along a dispensing passage of the dispensing device; b) activating at least one exit motor of the dispensing device, i) wherein the at least one exit motor is operatively connected to at least (a) the stationary displacement optical sensor of the dispensing device, (b) an exit sensor of the dispensing device, and (c) at least one exit roller of the dispensing device, ii) wherein, upon activation, the at least one exit motor rotates at least one exit roller and wherein the at least one exit roller pulls the portion of the dispensing object along the dispensing passage, and iii) wherein the exit sensor is positioned after the at least one exit roller; c) generating, by the exit sensor, a first signal indicating that a leading edge of the portion of the dispensing object has activated the exit sensor, wherein the exit sensor is operatively connected to the stationary displacement optical sensor; d) generating, upon receiving the first signal, by the stationary displacement optical sensor, a second signal when, by passing at least one light beam over a surface of the portion of the dispensing object, the stationary displacement optical sensor determines that the portion of the dispensing object has traveled a pre-determined distance along the dispensing passage; e) stopping, based on receiving the second signal, the at least one feeding and the at least one exiting motors; f) separating, based on receiving the second signal, the portion of the dispensing object from a remaining portion of the dispensing object; g) re-activating, after separating the portion of the dispensing object, the at least one feeding motor in a reverse movement to pull back, by the at least one feeding roller, the remaining portion of the dispensing object along the dispensing passage to a pre-set position; and h) re-activating, after separating the portion of the dispensing object, the at least one exit motor to dispense the portion of the dispensing object by rotating the at least one exit roller until the exit sensor continues to be activated by the travelling portion of the dispensing object.

In one example, the instant invention is a method for dispensing that may include steps of: a) activating at least one feeding motor of a dispensing device in a forward movement, i) wherein the at least one feeding motor is operatively connected to at least (a) a stationary displacement optical sensor of the dispensing device and (b) at least one feeding roller of the dispensing device, ii) wherein, upon activation, the at least one feeding motor rotates at least one feeding roller of the dispensing device, and iii) wherein, during the forward movement, the at least one feeding roller pushes a portion of a dispensing object along a dispensing passage of the dispensing device; b) activating at least one exit motor of the dispensing device, i) wherein the at least one exit motor is operatively connected to at least (a) the stationary displacement optical sensor, (b) an exit sensor of the dispensing device, and (c) at least one exit roller of the dispensing device, ii) wherein, upon activation, the at least one exit motor rotates at least one exit roller and wherein the at least one exit roller pulls the portion of the dispensing object along the dispensing passage, and iii) wherein the exit sensor is positioned after the at least one exit roller; c) generating, by the exit sensor, a first signal indicating that a leading edge of the portion of the dispensing object has activated the exit sensor, wherein the exit sensor is operatively connected to the stationary displacement optical sensor; d) generating, upon receiving the first signal, by the stationary displacement optical sensor, a second signal, when, by capturing, at a predetermined rate, image frames of a surface of the portion of the dispensing, the stationary displacement optical sensor determines that the portion of the dispensing object has traveled a pre-determined distance along the dispensing passage; e) stopping, based on receiving the second signal, the at least one feeding and the at least one exiting motors when the portion of the dispensing object has traveled the predetermined distance; f) separating, based on receiving the second signal, the portion of the dispensing object from a remaining portion of the dispensing object; g) re-activating, after separating the portion of the dispensing object, the at least one feeding motor in a reverse movement to pull back, by the at least one feeding roller, the remaining portion of the dispensing object along the dispensing passage to a pre-set position; and h) re-activating, after separating the portion of the dispensing object, the at least one exit motor to dispense the portion of the dispensing object by rotating the at least one exit roller until the exit sensor continues to be activated by the travelling portion of the dispensing object.

In one example, the instant invention is a method for dispensing that may include steps of: a) activating at least one feeding motor of a dispensing device in a forward movement, i) wherein the at least one feeding motor is operatively connected to at least (a) a stationary displacement optical sensor of the dispensing device and (b) at least one feeding roller of the dispensing device, ii) wherein, upon activation, the at least one feeding motor rotates at least one feeding roller of the dispensing device, and iii) wherein, during the forward movement, the at least one feeding roller pushes a portion of a dispensing object along a dispensing passage of the dispensing device; b) activating at least one exit motor of the dispensing device, i) wherein the at least one exit motor is operatively connected to at least (a) a stationary displacement optical sensor, (b) an exit sensor of the dispensing device, and (c) at least one exit roller of the dispensing device, ii) wherein, upon activation, the at least one exit motor rotates at least one exit roller and wherein the at least one exit roller pulls the portion of the dispensing object along the dispensing passage, and iii) wherein the exit sensor is positioned after the at least one exit roller; c) generating, by the exit sensor, a first signal indicating that a leading edge of the portion of the dispensing object has activated the exit sensor, wherein the exit sensor is operatively connected to the stationary displacement optical sensor; d) generating, upon receiving the first signal, a second signal based on data received from the stationary displacement optical sensor; wherein, based on a perimeter of the at least one passive wheel, the stationary displacement optical sensor determines that the portion of the dispensing object has traveled a pre-determined distance along the dispensing passage, i) wherein at least one passive wheel continuously contacts a first side of the portion of the dispensing object and is operatively connected to the stationary displacement optical sensor, and ii) wherein the perimeter corresponds to a surface of the at least one passive wheel that has touched the portion of the dispensing object after the stationary displacement optical sensor receives the first signal; e) stopping, based on receiving the second signal, the at least one feeding and the at least one exiting motor when the portion of the dispensing object has traveled the predetermined distance; f) separating, based on receiving the second signal, the portion of the dispensing object from a remaining portion of the dispensing object; and g) re-activating, after separating the portion of the dispensing object, the at least one feeding motor in a reverse movement to pull back, by the at least one feeding roller, the remaining portion of the dispensing object along the dispensing passage to a pre-set position; and h) re-activating, after separating the portion of the dispensing object, the at least one exit motor to dispense the portion of the dispensing object by rotating the at least one exit roller until the exit sensor continues to be activated by the travelling portion of the dispensing object.

In one example, the data received from the stationary displacement optical sensor is based on: i) passing at least one light beam from the stationary displacement optical sensor over a second side of the portion of the dispensing object, traveling along the dispensing passage, and ii) detecting characteristics of returned light.

In one example, the data received from the stationary displacement optical sensor is based on: i) capturing, at a predetermined rate, by the stationary displacement optical sensor, image frames of a second side of the portion of the dispensing object, traveling along the dispensing passage, and ii) detecting differences between sequential image frames.

In one example, the at least on feeding motor has a speed of X, wherein the at least on exit motor has a speed of Y, and wherein a difference between X and Y is maintained so as to maintain the traveling portion of the dispensing object at a distance from the stationary displacement optical sensor and in a state of tension, without separating the portion from the remaining portion of the dispensing object prior to the separating step.

In one example, the method further comprise using a tension mechanism to maintain the traveling portion of the dispensing object at a distance from the stationary displacement optical sensor and in a state of tension, without separating the portion from the remaining portion of the dispensing object prior to the separating step.

In one example, the at least one light beam is a non-coherent light beam.

In one example, at least one light beam is a coherent light beam.

In one example, the surface of the portion of the dispensing object corresponds to at least one side of the portion of the dispensing object.

While a number of embodiments of the present invention have been described, it is understood that these embodiments are illustrative only, and not restrictive, and that many modifications and/or alternative embodiments may become apparent to those of ordinary skill in the art. For example, any steps may be performed in any desired order (and any desired steps may be added and/or any desired steps may be deleted). Therefore, it will be understood that the appended claims are intended to cover all such modifications and embodiments that come within the spirit and scope of the present invention.

We claim:

1. A method for dispensing, comprising:

initiating a forward movement of a strip of tickets along a dispensing passage of a dispensing device, wherein the forward movement is initiated from a pre-set starting position and wherein the strip of tickets comprises a plurality of tickets;

during the forward movement of the strip of tickets along the dispensing passage from the pre-set starting position:

determining, by at least one displacement sensor, a magnitude of a displacement of the strip of tickets along the dispensing passage based on remotely measuring, by at least one displacement sensor, at least one surface characteristic associated with a surface of the strip of tickets wherein the remotely measuring, by the at least one displacement sensor, is based, at least in part, on:

1) directing at least one light beam at the surface of the strip of tickets, and 2) taking, by the at least one displacement sensor, a plurality of images of the surface of the strip of tickets;

generating at least one first indication by the at least one displacement sensor when the magnitude of the displacement is equal to or exceeds a pre-determined distance value;

cutting, based on the at least one first indication, a ticket from the strip of tickets to form a remaining portion of the strip of tickets and the ticket;

moving the remaining portion of the strip of tickets back to the pre-set starting position; and dispensing the ticket.

2. The method of claim 1, wherein the method further comprises:

generating, by at least one exit sensor positioned next to an exit end of the dispensing passage of the dispensing device, at least one second indication when the strip of tickets reaches the at least one exit sensor, wherein the determining, by the at least one displacement sensor, of the magnitude of the displacement of the strip of tickets along the dispensing passage begins after the at least one displacement sensor receives the at least one second indication.

3. The method of claim 1, wherein the at least one light beam is a noncoherent light beam.

4. The method of claim 1, wherein the at least one light beam is a coherent light beam.

5. The method of claim 1, wherein the method further comprises:

maintaining, by at least one tension mechanism, the strip of tickets in a state of tension and at a pre-determined separation distance away from the at least one displacement sensor.

6. The method of claim 5, wherein the at least one tension mechanism comprises at least one active roller.

7. The method of claim 5, wherein the at least one tension mechanism further comprises a plurality of active rollers, wherein the plurality of active rollers comprises at least one feeding roller rotating at a first speed and at least one exit roller rotating at a second speed, and wherein the first and the second speeds are different.

8. The method of claim 1, wherein the plurality of tickets are lottery tickets and wherein the ticket is a lottery ticket.

9. A device for dispensing, comprising:

a plurality of feed rollers that are designed to initiate a forward movement of a strip of tickets along a dispensing passage of the device, wherein the forward movement is initiated from a pre-set starting position and wherein the strip of tickets comprises a plurality of tickets;

at least one displacement sensor, wherein the displacement sensor is designed to determine a magnitude of a displacement of the strip of tickets along the dispensing passage based on remotely measuring, by the at least one displacement sensor, at least one surface characteristic associated with a surface of the strip of tickets during the forward movement of the strip of tickets along the dispensing passage from the pre-set starting position, wherein the remotely measuring, by the at least one displacement sensor, is based, at least in part, on:

the at least one displacement sensor being designed to take a plurality of images of the surface of the strip of tickets when the at least one light beam is directed at the surface of the strip of tickets; and wherein the at least one displacement sensor generates at least one first indication when the magnitude of the displacement is equal to or exceeds a pre-determined distance value; and at least one cutting mechanism that is designed to separate, based on the at least one first indication, a ticket from the strip of tickets to form a remaining portion of the strip of tickets and the ticket, wherein the plurality of feed rollers move the remaining portion of the strip of tickets back to the pre-set starting position, and wherein the dispensing device dispenses the ticket.

10. The device of claim 9, wherein the device further comprises:

at least one exit sensor that is positioned next to an exit end of the dispensing passage of the dispensing device and that is designed to generate at least one second indication when the strip of tickets reaches the at least one exit sensor, wherein the at least one displacement sensor begins to determine the magnitude of the displacement of the strip of tickets along the dispensing passage after the at least one displacement sensor receives the at least one second indication.

11. The device of claim 9, wherein the method further comprises:

at least one tension mechanism that is designed to maintain the strip of tickets in a state of tension and at a pre-determined separation distance away from the at least one displacement sensor.

12. The device of claim 11, wherein the at least one tension mechanism comprises at least one active roller.

13. The device of claim 11, wherein the at least one tension mechanism further comprises a plurality of active rollers, wherein the plurality of active rollers comprises at least one feeding roller rotating at a first speed and at least one exit roller rotating at a second speed, and wherein the first and the second speeds are different.

14. The device of claim 9, wherein the plurality of tickets are lottery tickets and wherein the ticket is a lottery ticket.

* * * * *